US009463391B2

(12) United States Patent
Job et al.

(10) Patent No.: US 9,463,391 B2
(45) Date of Patent: Oct. 11, 2016

(54) FLYING THEATRE

(71) Applicant: Dynamic Structures, Ltd., Port Coquitlam (CA)

(72) Inventors: Richard Job, Pitt Meadows (CA); Emile Van Vuuren, Vancouver (CA); Ye Zhou, Vancouver (CA); David Halliday, Maple Ridge (CA); Nathan Loewen, North Vancouver (CA); Mike Gedig, Brooklyn, NY (US)

(73) Assignee: Dynamic Structures, Ltd., Port Coquitlam (CA)

( * ) Notice: Subject to any disclaimer, the term of this patent is extended or adjusted under 35 U.S.C. 154(b) by 0 days.

(21) Appl. No.: 14/436,286

(22) PCT Filed: Oct. 23, 2013

(86) PCT No.: PCT/CA2013/050802

§ 371 (c)(1),
(2) Date: Apr. 16, 2015

(87) PCT Pub. No.: WO2014/063250

PCT Pub. Date: May 1, 2014

(65) Prior Publication Data

US 2015/0273348 A1 Oct. 1, 2015

Related U.S. Application Data

(60) Provisional application No. 61/721,840, filed on Nov. 2, 2012.

(30) Foreign Application Priority Data

Oct. 26, 2012 (CA) ..... 2793598

(51) Int. Cl.

| | |
|---|---|
| ***A63G 31/16*** | (2006.01) |
| ***A63G 31/02*** | (2006.01) |
| *G09B 9/02* | (2006.01) |

(52) U.S. Cl.

CPC ..... *A63G 31/16* (2013.01); *A63G 31/02* (2013.01)

(58) Field of Classification Search

CPC ..... A63G 27/00; A63G 27/02; A63G 31/00; A63G 31/02; A63G 31/16; A47C 1/00; A47C 1/12; A47C 1/035; G09B 9/00; G09B 9/02; G09B 9/08; G09B 9/10; G09B 9/12

USPC ..... 472/59, 60, 61, 130, 136; 434/29, 30, 434/35, 55, 59

See application file for complete search history.

(56) References Cited

U.S. PATENT DOCUMENTS 4,879,849 A 11/1989 Hollingsworth, III et al.
5,509,631 A * 4/1996 De Salvo ..... G09B 9/12 248/370

(Continued)

FOREIGN PATENT DOCUMENTS

CN 2609618 4/2004
CN 101025051 A 8/2007

(Continued)

OTHER PUBLICATIONS

European Supplementary Search Report issued on Jun. 24, 2016, regarding EP 13849780.5.

*Primary Examiner* — Kien Nguyen
(74) *Attorney, Agent, or Firm* — DLA Piper LLP (US)

(57) ABSTRACT

A motion base, comprising a pivot structure having a pivot point near the center of gravity of the pivot structure; a platform support by the pivot structure, the platform having a generally horizontal position and a generally vertical position; and, a drive for rotating of the pivot structure at the pivot point to move the platform from the generally horizontal position to the generally vertical position.

16 Claims, 36 Drawing Sheets

(56) References Cited

U.S. PATENT DOCUMENTS

| | | | | |
|---|---|---|---|---|
| 6,053,576 | A | 4/2000 | Jessee | |
| 6,354,954 | B1 * | 3/2002 | Sumner | A63G 31/16 472/45 |
| 8,225,555 | B2 * | 7/2012 | Magpuri | A63G 31/16 52/10 |
| 2005/0014567 | A1 | 1/2005 | Li et al. | |
| 2012/0258810 | A1 * | 10/2012 | Lai | A63G 7/00 472/59 |

FOREIGN PATENT DOCUMENTS

| | | |
|---|---|---|
| CN | 102100972 | 6/2011 |
| CN | 102728075 | 10/2012 |
| WO | WO 2007/057171 | 5/2007 |

* cited by examiner

FLYING THEATRE

CROSS-REFERENCE TO RELATED APPLICATIONS

This application is a 35 USC §371 National Stage application of International Application No. PCT/CA2013/050802 filed Oct. 23, 2013; which claims the benefit under 35 USC §119(e) to U.S. Application Ser. No. 61/721,840 filed Nov. 2, 2012, and the benefit under 35 USC §119(a) to Canada Application Serial No. 2793598 filed Oct. 26, 2012. The disclosure of each of the prior applications is considered part of and is incorporated by reference in the disclosure of this application.

FIELD OF THE INVENTION

The invention relates to the field of amusement rides and in particular to a motion base to be used as part of an amusement ride.

BACKGROUND

Rides have been, and still are, an important part of a visitor's experience to amusement parks. Amusement park rides have evolved from Ferris wheels, carousels, and simple roller coasters and train rides to large and technologically sophisticated entertainment complexes with integrated sight, sound, and motion.

A recent development in the amusement park industry is the use of guest-carrying motion bases that are used with large screens on which movies or images are shown. Movement of guests is performed by the motion base, and the movement is synchronized with the images being shown on the screen. The guests are provided with an immersive and cinematic experience, which contributes to the popularity of this type of amusement ride. The rides often provide a simulation of different types of experiences, including the simulation of flying.

To move guests safely while providing an immersive experience requires the use of systems that are safe and have safety redundancies. While movement of the guests from a horizontal position to a near vertical one creates a "flying" sensation that guests enjoy, safety is a significant concern.

Different ways to address the technical challenges behind these types of amusement rides have been used. Some rides use large canti-levers to raise the guests into the vertical position. In other amusement rides, guests are suspended in chairs that are hung from a support.

There are shortcomings to some of these amusement ride designs, including the need to use custom parts, the use of very heavy parts, high costs of installation, the need to build dedicated or new facilities to house the amusement ride, the mechanics being exposed to the guests participating in the ride, and guests having different sightlines depending on the location of the guests in the amusement ride.

A need therefore exists for an improved motion base for an amusement ride. Accordingly, a solution that addresses, at least in part, the above and other shortcomings is desired.

SUMMARY OF THE INVENTION

According to one aspect of the invention, there is provided a motion base, comprising: a pivot structure having a pivot point near the center of gravity of the pivot structure; a platform supported by the pivot structure, the platform having a generally horizontal position and a generally vertical position; and, a drive for rotating the pivot structure at the pivot point to move the platform from the generally horizontal position to the generally vertical position.

According to another aspect of the invention, there is provided a motion base, comprising: a pivot structure having a pivot point near the center of gravity of the pivot structure; a platform slidably mounted on the pivot structure, the platform having a generally horizontal position and a generally vertical position; at least one actuator and at least one counterbalancing member coupling the platform to the pivot structure; and, a drive for rotating the pivot structure at the pivot point to move the platform from the generally horizontal position to the generally vertical position, the at least one actuator and the at least one counterbalancing member generating a force opposite to the force generated by rotation of the pivot structure.

According to another aspect of the invention, there is provided a platform for use in an amusement ride, comprising: at least two seats arranged longitudinally; a seat drive member; a seat actuating member engaging the at least two seats longitudinally and coupled to the seat drive member; wherein pitch of the at least two seats is adjustable simultaneously by action of the seat drive member engaging the seat actuating member.

According to another aspect of the invention, there is provided a method generating simulated motion using a motion base and images presented on a screen in a theatre, comprising: showing the images on the screen starting with zoomed out images and ending with zoomed in images; and, moving a platform of the motion base on which guests are positioned from a horizontal position to a vertical position in synchronization with the shown images, wherein the platform of the motion base is in the horizontal position when the zoomed out images are shown and the platform of the motion base in the vertical position when the zoomed in images are shown.

BRIEF DESCRIPTION OF THE DRAWINGS

Features and advantages of the embodiments of the present invention will become apparent from the following detailed description, taken in combination with the appended drawings, in which.

In the description which follows, like parts are marked throughout the specification and the drawings with the same respective reference numerals.

DETAILED DESCRIPTION OF THE EMBODIMENTS

The description which follows and the embodiments described therein are provided by way of illustration of an example or examples of particular embodiments of the principles of the present invention. These examples are provided for the purposes of explanation and not limitation of those principles and of the invention. In some instances, certain structures and techniques have not been described or shown in detail in order not to obscure the invention.

Figure 1:
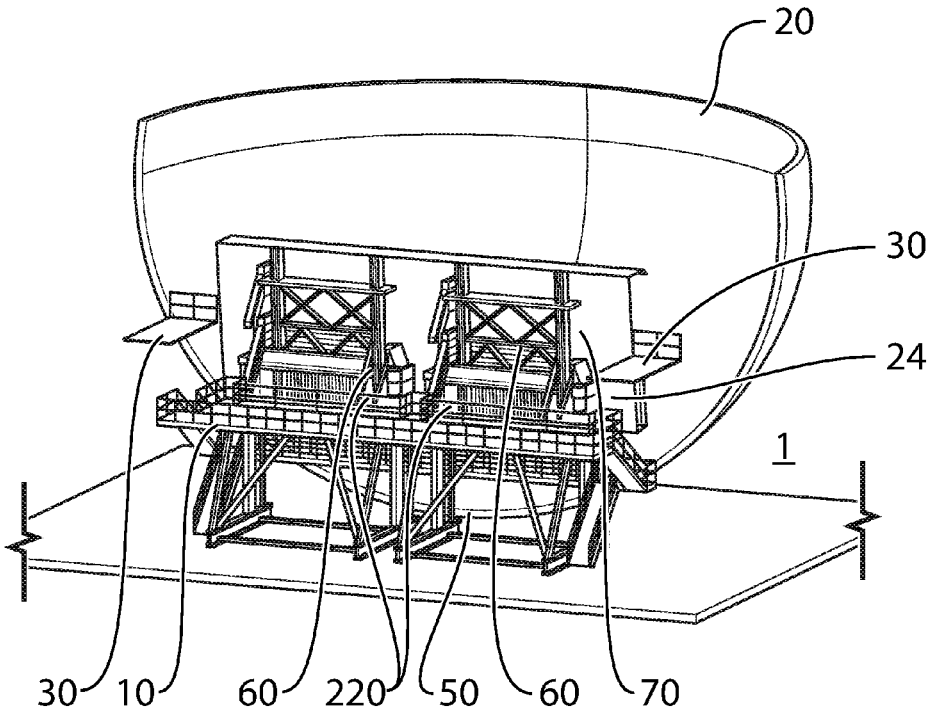
FIG. 1 is a rear perspective view illustrating two motion bases implemented in a theatre in accordance with an embodiment of the invention.
Figure 2:
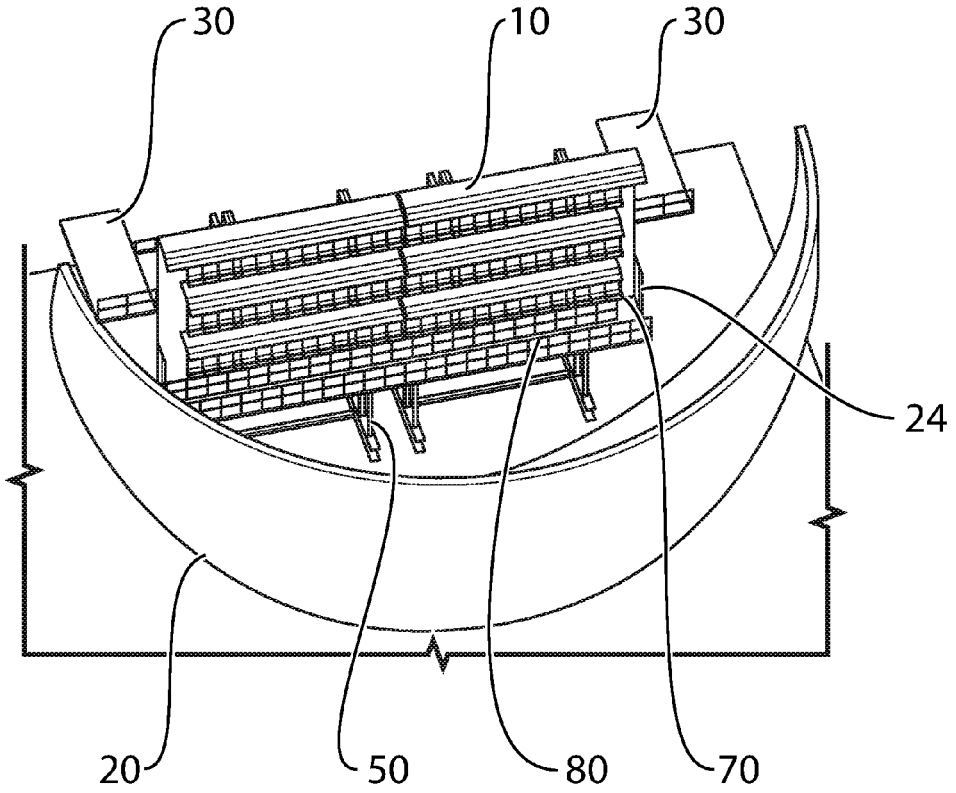
FIG. 2 is a top perspective view illustrating the motion bases of FIG. 1 in accordance with an embodiment of the invention.

FIG. 1 is a rear perspective view illustrating two motion bases 10 implemented in a theatre 1 in accordance with an embodiment of the invention and FIG. 2 is a top perspective view illustrating the motion bases 10 of FIG. 1 in accordance with an embodiment of the invention. According to one embodiment, the motion base 10 may be fitted in a theatre 1 having a screen 20. Guests are able to enter the theatre 1 onto a platform 70 of the motion base 10 through the use of walk-in platforms 30. The motion base 10 is adapted for use with the platform 70 in two main operational positions, namely a horizontal position 22 and a vertical position 24. In the horizontal position 22, guests can load and unload from the platform 70 of the motion base 10. In the vertical position 24, guests are seated on seats 80 and presentations in the theatre 1 are predominantly made when the platform 70 of the motion base 10 is in the vertical position 24.

Figure 3:
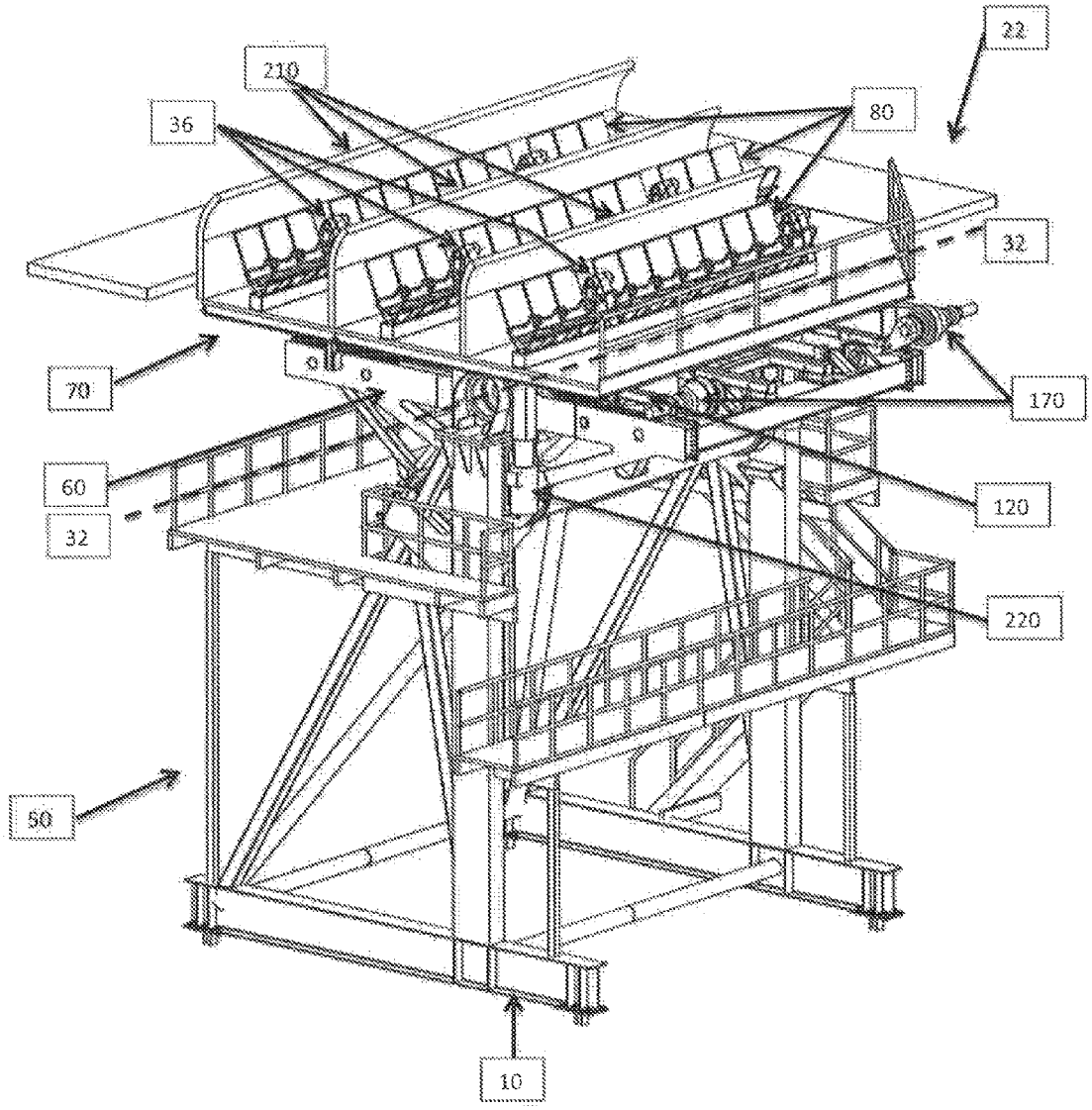
FIG. 3 is an isometric view illustrating one of the motion bases of FIG. 1 with its platform in a horizontal position in accordance with an embodiment of the invention.
Figure 4:
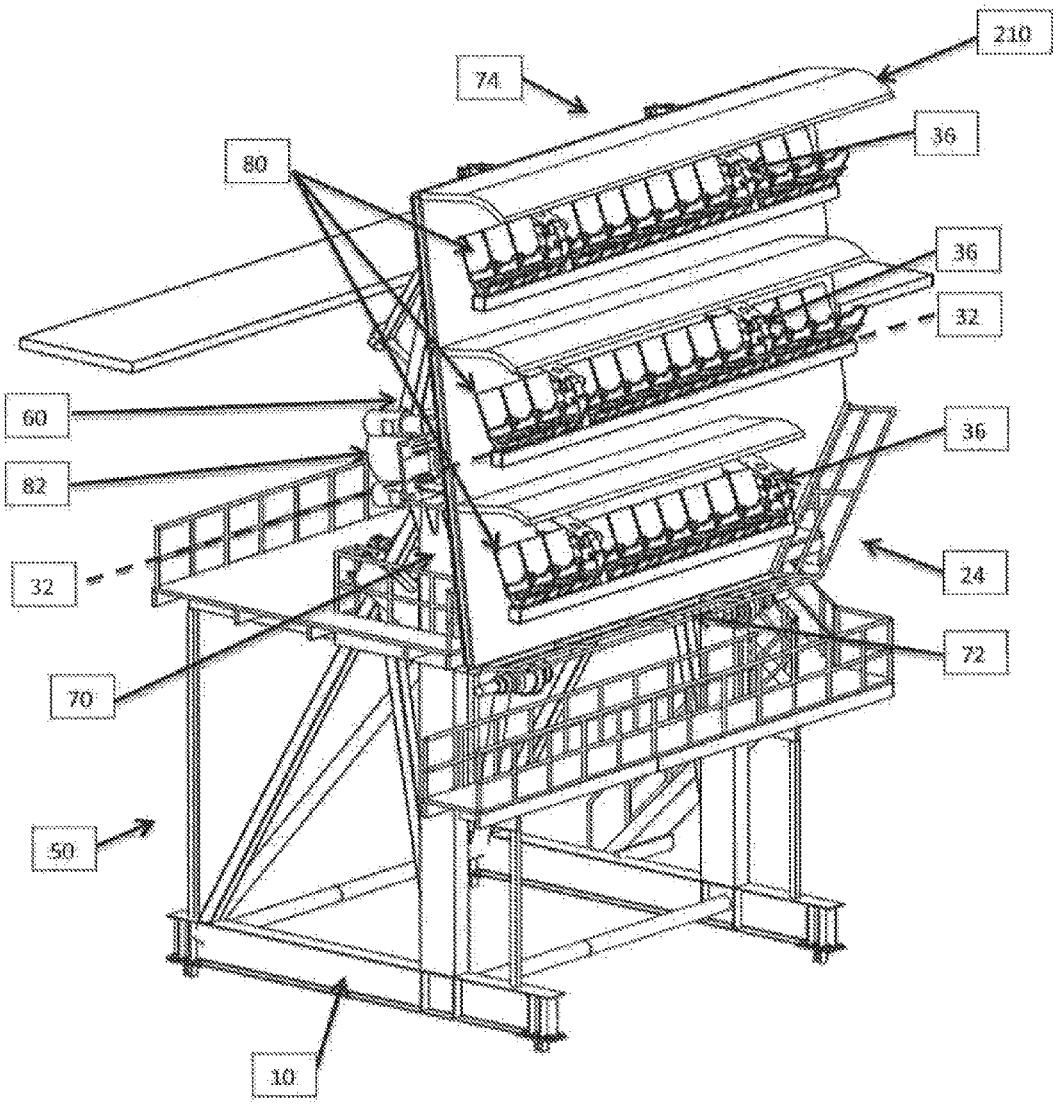
FIG. 4 is an isometric view illustrating the motion base of FIG. 3 with its platform in a vertical position in accordance with an embodiment of the invention.
Figure 5:
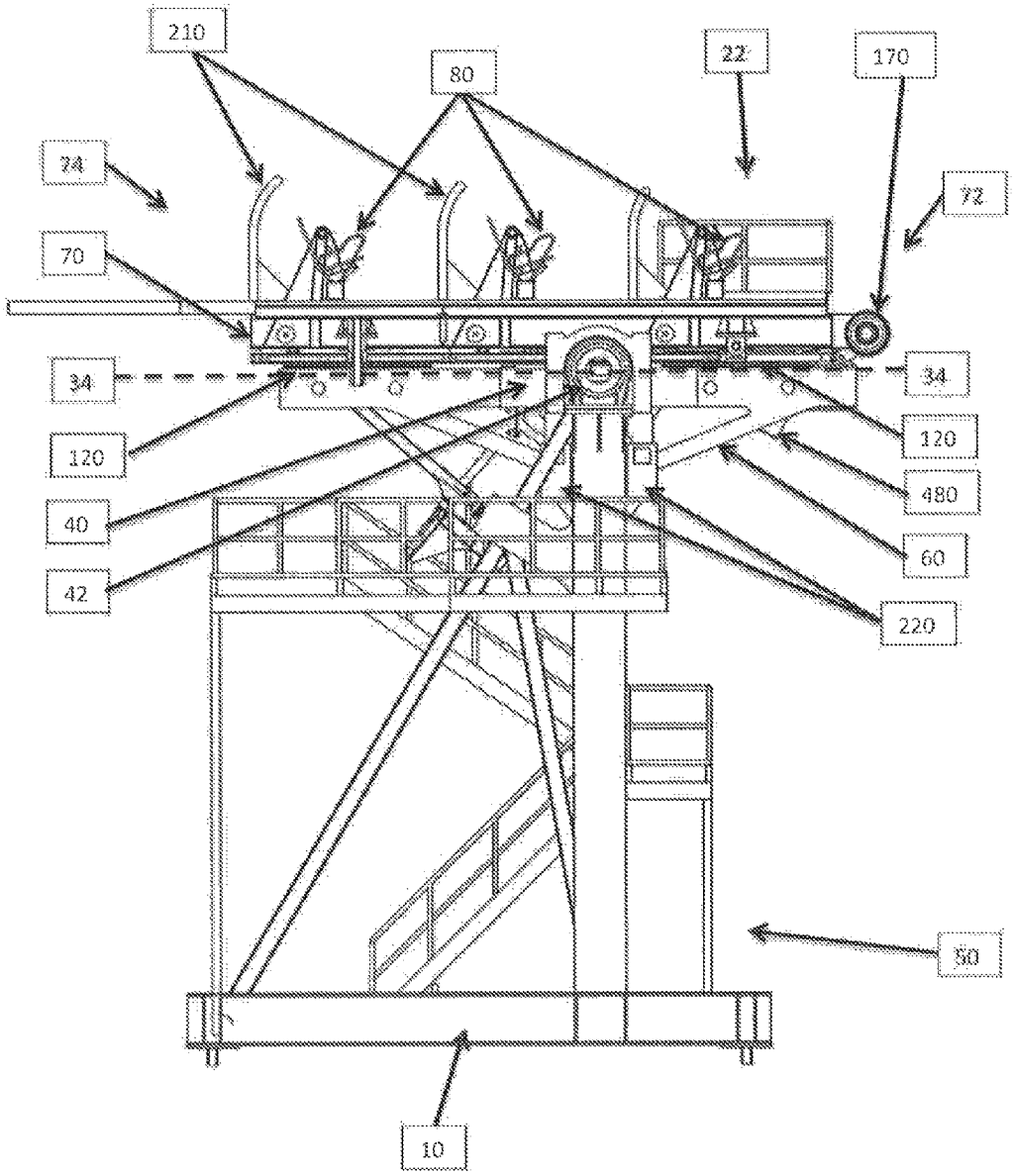
FIG. 5 is a side view illustrating the motion base of FIG. 3 with its platform in a horizontal position in accordance with an embodiment of the invention.
Figure 6:
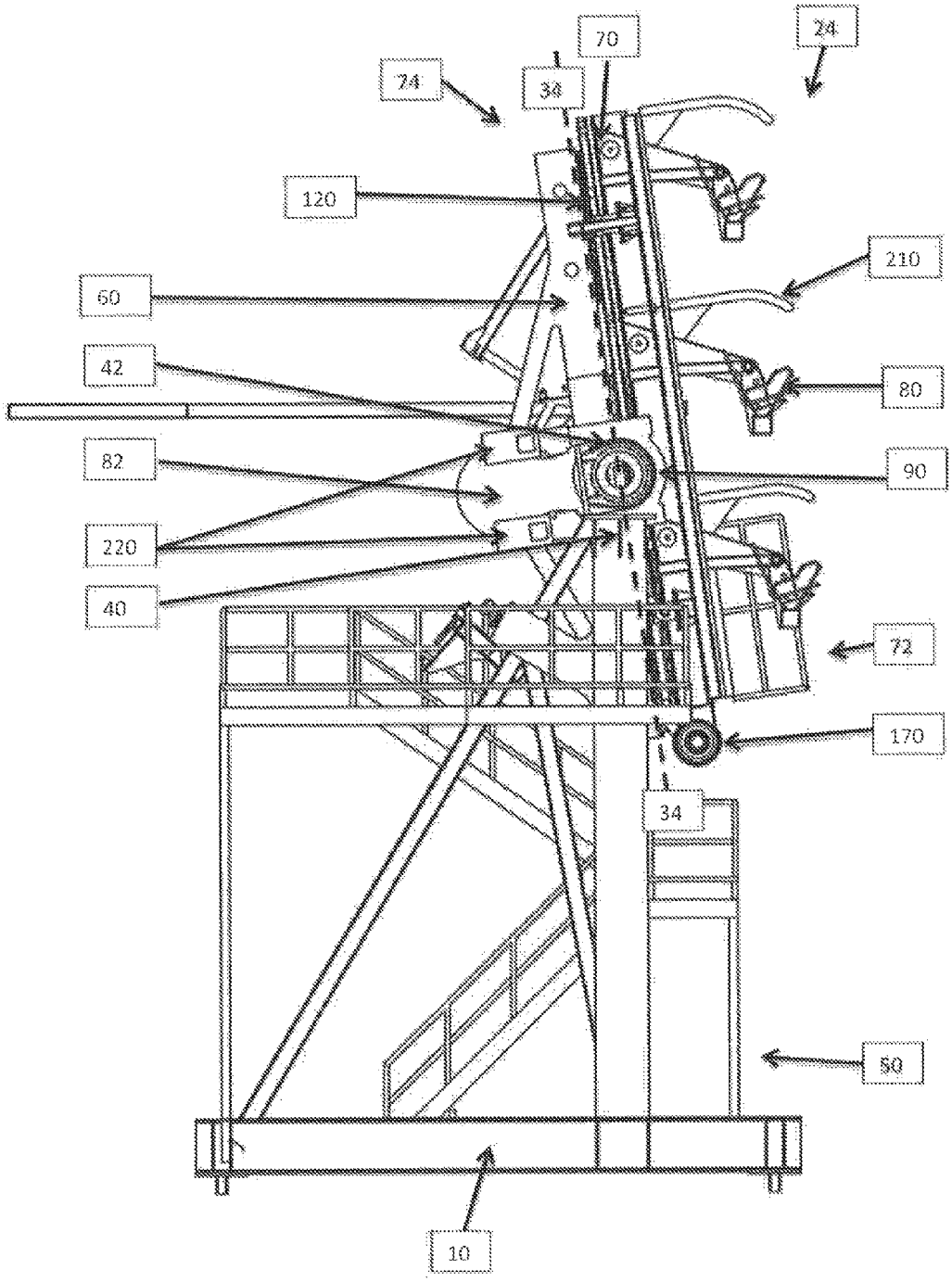
FIG. 6 is a side view illustrating the motion base of FIG. 3 with its platform in a vertical position in accordance with an embodiment of the invention.
Figure 7:
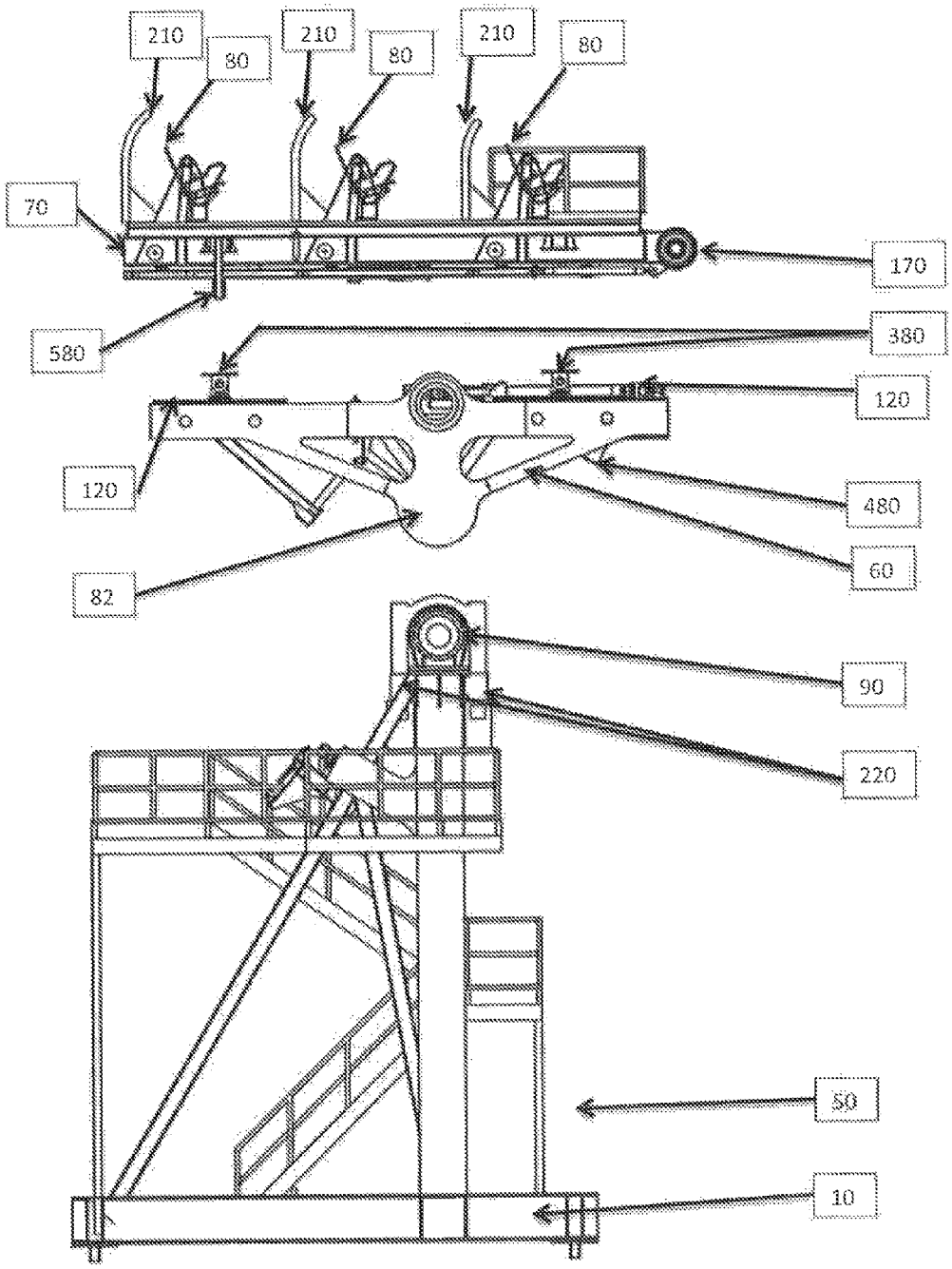
FIG. 7 is an exploded side view illustrating the motion base of FIG. 3 with its platform in a horizontal position in accordance with an embodiment of the invention.

FIG. 3 is an isometric view illustrating one of the motion bases 10 of FIG. 1 with its platform 70 in a horizontal position 22 in accordance with an embodiment of the invention and FIG. 4 is an isometric view illustrating the motion base 10 of FIG. 3 with its platform 70 in a vertical position 24 in accordance with an embodiment of the invention. FIG. 5 is a side view illustrating the motion base 10 of FIG. 3 with its platform 70 in a horizontal position 22 in accordance with an embodiment of the invention, and FIG. 6 is a side view illustrating the motion base 10 of FIG. 3 with its platform 70 in a vertical position 24 in accordance with an embodiment of the invention. FIG. 7 is an exploded side view illustrating the motion base 10 of FIG. 3 with its platform 70 in a horizontal position 22 in accordance with an embodiment of the invention. The motion base 10 includes the platform 70, a pivot structure 60, and a support structure 50. According to one embodiment, the platform 70 is supported by the pivot structure 60 and the pivot structure 60 is supported by the support structure 50. The support structure 50 is the stationary portion of the motion base 10 and is mounted to the foundation of the theatre 1. The pivot structure 60 is the rotating portion of the motion base 10 and is supported on top of the support structure 50. The platform 70 is the upper portion of the motion base 10 and is slidable relative to the pivot structure 60. In one embodiment, the platform 70 is mounted on the pivot structure 60 through guiding members 120. In one embodiment, two sets of guiding members 120 are used to facilitate sliding of the platform 70.

Persons skilled in the art will appreciate the type of materials that may be used for components of the motion base 10. In one embodiment, the frame of the pivot structure 60, the support structure 50, and the platform 70 may be made of steel. In other embodiments, aluminum may be used. In one embodiment, fibre reinforced plastic may be used for the flooring on the platform 70. In other embodiments, metal or wood may be used for such flooring. In one embodiment, the seats 80 may be metal. In other embodiments, plastic or fibre reinforced plastic framing may be used for the seats 80.

According to one embodiment, at the start of a presentation, movie or show, the platform 70 of the motion base 10 is in the horizontal position 22, and, as such, the guests in the theatre 1 are presented with the appearance of an advanced curved screen arena. The lower half of the screen 20 is kept dark. As part of the show sequence, the platform 70 of the motion base 10 indexes to the vertical or near vertical position 24, with a horizontal dark line following the transition from the horizontal position 22 to the vertical position 24, giving a breathtaking "reveal moment" into a fully immersive projected environment. In the vertical position 24, the platform 70 and the seats 80 move in unison with the projected images on the screen 20.

At the end of the show sequence, the platform 70 of the motion base 10 and seats 80 return to the horizontal position 22 and the guests are invited to exit the theatre 1 through the walk-in platforms 30.

As illustrated in FIGS. 3, 4, 5, and FIG. 6, the motion base 10 is capable of three degrees-of-freedom, namely movement about a pivot axis 32, along a heave axis 34, and about a seat pitch axis 36. Movement around the pivot axis 32 is facilitated by the pivot structure 60. Movement along the heave axis 34 is facilitated by the platform 70 sliding on the pivot structure 60 on top of the guiding members 120 via operation of the actuator 130 and the counterbalancing member 140. Movement around the seat pitch axis 36 is facilitated by mechanisms driving the seats 80.

Figure 8:
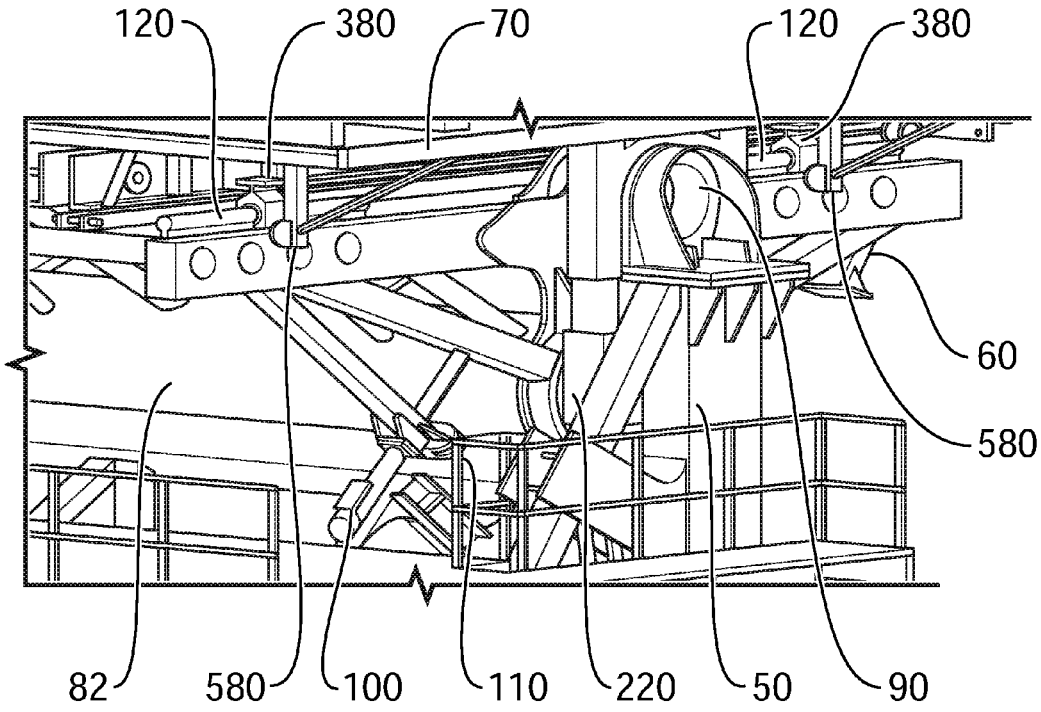
FIG. 8 is an isometric view illustrating the pivot structure of the motion base of FIG. 3 with its platform in a horizontal position in accordance with an embodiment of the invention.
Figure 9:
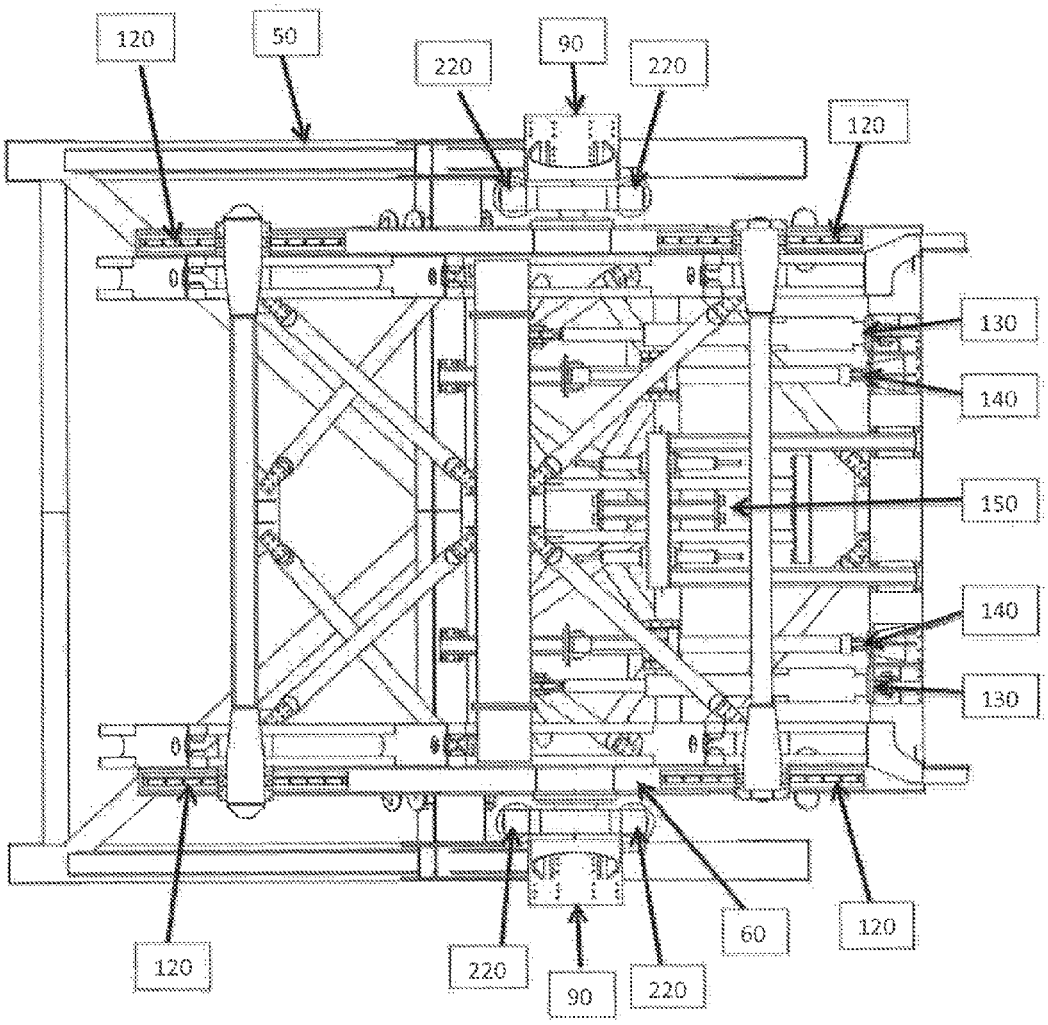
FIG. 9 is a top view illustrating the pivot structure of the motion base of FIG. 3 with its platform in a horizontal position in accordance with an embodiment of the invention.
Figure 10:
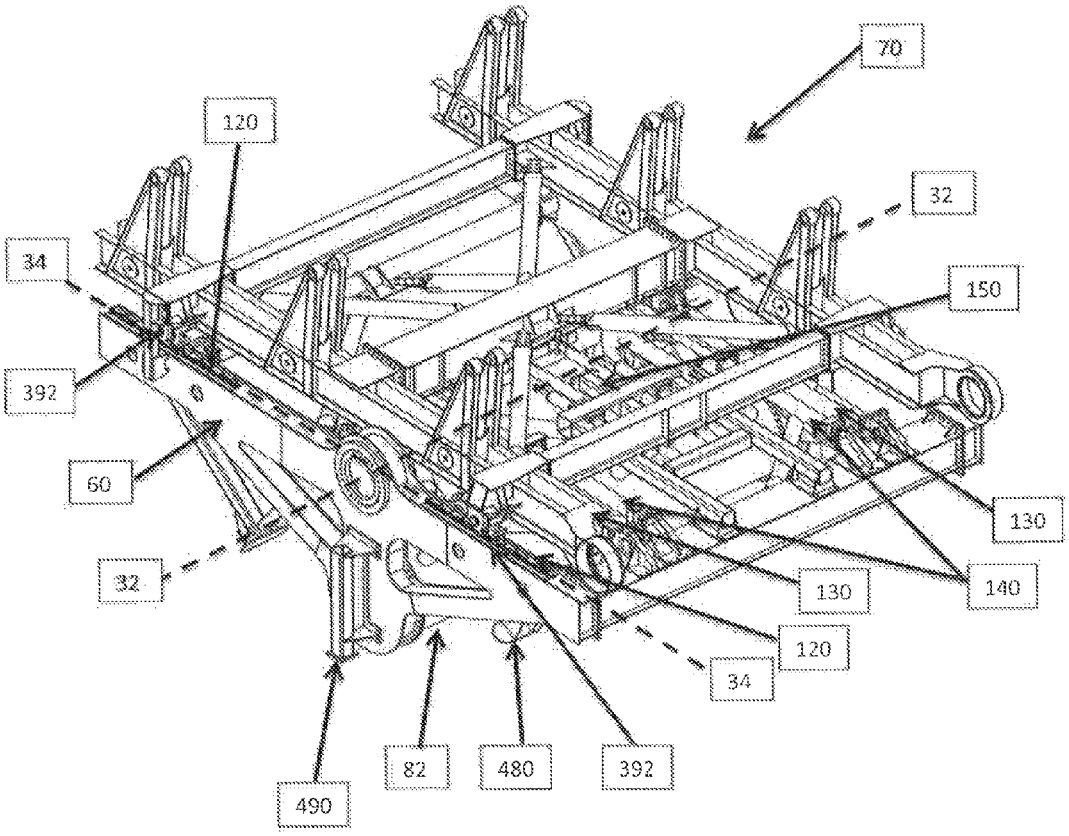
FIG. 10 is a top isometric view illustrating the pivot structure of the motion base of FIG. 3 with its platform in a horizontal position in accordance with an embodiment of the invention.
Figure 11:
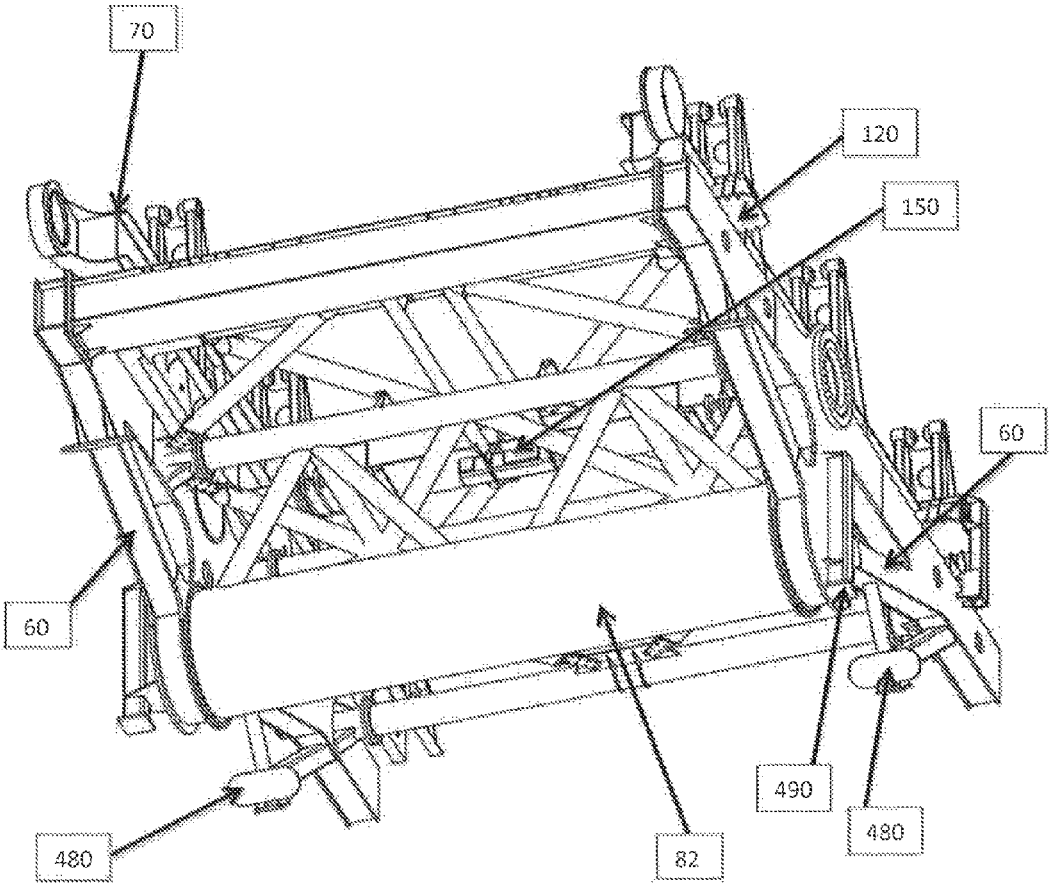
FIG. 11 is a bottom isometric view illustrating the pivot structure of the motion base of FIG. 3 with its platform in a horizontal position in accordance with an embodiment of the invention.

FIG. 8 is an isometric view illustrating the pivot structure 60 of the motion base 10 of FIG. 3 with its platform 70 in a horizontal position 22 in accordance with an embodiment of the invention. FIG. 9 is a top view illustrating the pivot structure 60 of the motion base 10 of FIG. 3 with its platform 70 in a horizontal position 22 in accordance with an embodiment of the invention. FIG. 10 is a top isometric view illustrating the pivot structure 60 of the motion base 10 of FIG. 3 with its platform 70 in a horizontal position 22 in accordance with an embodiment of the invention. FIG. 11 is a bottom isometric view illustrating the pivot structure 60 of the motion base 10 of FIG. 3 with its platform 70 in a horizontal position 22 in accordance with an embodiment of the invention.

The pivot structure 60 includes linear guide members 120, a counterweight member 82, a drive member 90, an actuator 130, and a counterbalancing member 140. The drive member 90 facilitates rotation of the pivot structure 60 to allow rotation of the pivot structure 60 about the pivot axis 32 at the pivot points 42. Optionally, the pivot structure 60 may include shock absorbers 150. The linear guide members 120 provide rigid lateral support to the platform 70 and allow the platform 70 to slide on top of the pivot structure 60 as the pivot structure 60 moves to cause the motion base 10 to shift the platform 70 to move from the horizontal position 22 to the vertical position 24. The pivot structure 60 may also include a pivot axis stopping member 110. In one embodiment, the pivot axis stopping member 110 is mounted on the pivot structure 60 and the pivot axis stopping member 110 may strike the support structure 50 and stop further motion of the pivot structure 60 when the pivot structure 60 reaches its travel limit.

The counterweight member 82 serves as a counterweight to position the overall center of gravity 40 of the pivot structure 60 and the platform 70 closer to the pivot axis 32. In one embodiment, the counterweight member 82 is a structural steel pipe mounted on the pivot structure 60. In another embodiment, the counterweight member 82 is partially filled with concrete to provide for additional weight. The amount of counterweight in the counterweight member 82 is set such that the center of gravity 40 of the entire pivoting assembly, including the pivot structure 60, the platform 70, the canopies 210, the seats 80, and the guests on the seats 80, is located at or near the pivot axis 32 when the platform 70 is at its mid-stroke position along the heave axis 34. As the platform 70 moves along the heave axis 34 towards the front 72 of the pivot structure 60, the center of gravity 40 moves slightly forwards of the pivot axis 32, and as the platform 70 moves along the heave axis 34 towards the rear 74 of the pivot structure 60, the center of gravity 40 moves slightly rearwards of the pivot axis 32.

The actuator 130 is for driving the platform 70 along the heave axis 34 of the motion base 10. In one embodiment, the actuator 130 is a roller-screw electrically driven actuator which converts rotary motion from an electric motor into linear motion of the actuator. In other embodiments, a pair of the actuators 130 is provided on either side of the pivot structure 60. The counterbalancing member 140 works passively to carry a portion of the static load of the platform 70. The counterbalancing member 140 creates a constant force that counteracts the weight of the pivot structure 60 and the platform 70 as closely as possible in order to reduce the load supported by the actuators 130. In one embodiment, a pair of the counterbalancing members 140 is provided, one on either side of the pivot structure 60. By reducing the total load carried by the actuator 130, less expensive and smaller actuators may be used. In one embodiment, the counterbalancing members 140 are hydraulic cylinders that are plumbed to large accumulators so that the pressure fluctuation over the range of motion is minimal. In one embodiment, the pressure in the hydraulic cylinders and accumulators is set to carry 75% of the total static load of the platform 70 when loaded to 50% of nominal guest capacity. In such embodiment, the actuators 130 and the counterbalancing members 140 work together to exert a force that is opposite to the force created by movement of the platform 70 along the linear guide members 120 as a result of the motion base 10 causing the platform 70 to move from the horizontal position 22 to the vertical position 24.

In another embodiment, the counterbalancing members 140 include two main components, namely, hydraulic cylinders and accumulators. The hydraulic cylinders are filled with hydraulic fluid which is plumbed from the hydraulic cylinder to the accumulator. The accumulator is partly filled with a compressed gas and partly filled with hydraulic fluid which is plumbed back to the hydraulic cylinder. The gas and fluid compartments of the accumulator are separated by a bladder or a piston inside of the accumulator so that they remain physically separated even though the gas and fluid are always equalized at the same pressure. As the hydraulic cylinder is compressed, it forces more fluid into the accumulator, thus reducing the volume of the gas inside the accumulator, which increases the pressure in the gas. This correspondingly increases the pressure in the hydraulic fluid since it has the same pressure as the gas. As the hydraulic cylinder is compressed, the force exerted by the hydraulic cylinder is increased. In one embodiment, the counterbalancing members 140 include hydraulic cylinders with the volume of gas in the accumulator being very large relative to the volume of fluid in the hydraulic cylinder. As such, when the hydraulic cylinder is compressed, the change of volume of gas in the accumulator is small compared to its overall volume, and thus the change in the force in the hydraulic cylinder is also small. The result is that the hydraulic cylinder has a nearly constant restoring force over its entire stroke length as the counterbalancing members 130 are counteracting the effects of gravity on the platform 70 as the platform 70 of the motion base 10 moves from the horizontal position 22 to the vertical position 24.

Figure 12:
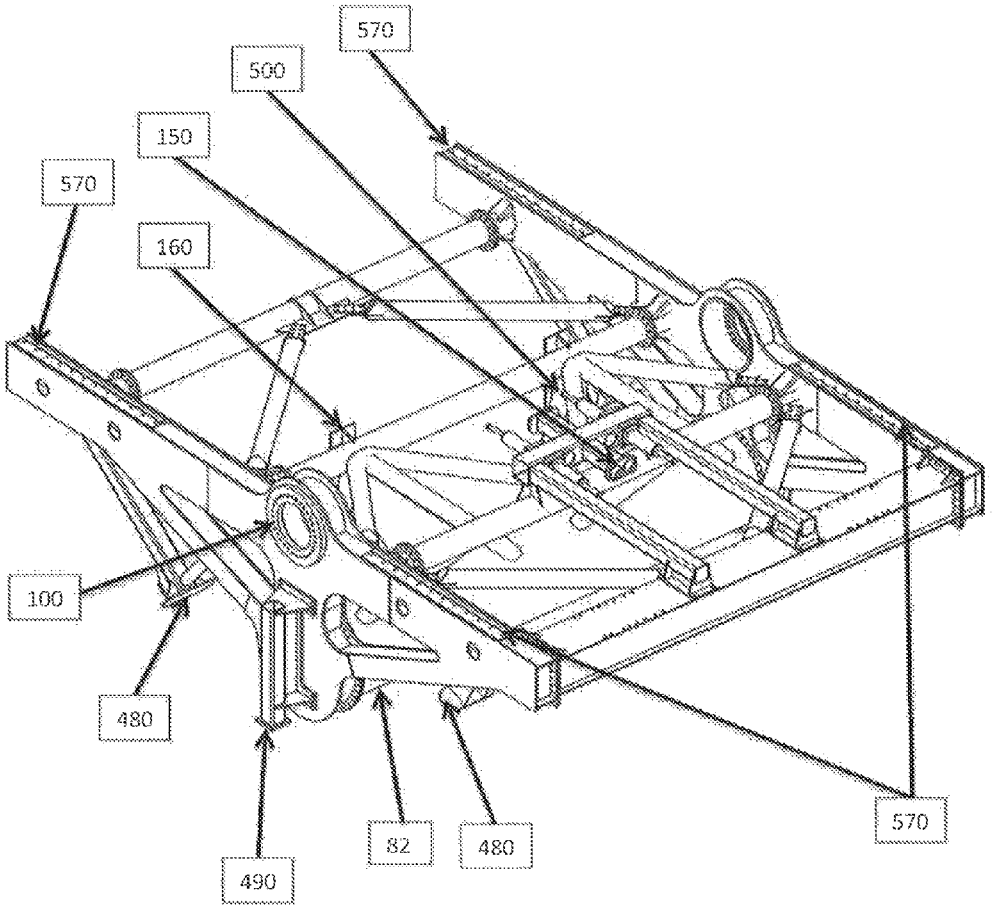
FIG. 12 is an isometric view illustrating the pivot structure of the motion base of FIG. 3 in a horizontal position in accordance with an embodiment of the invention.
Figure 13:
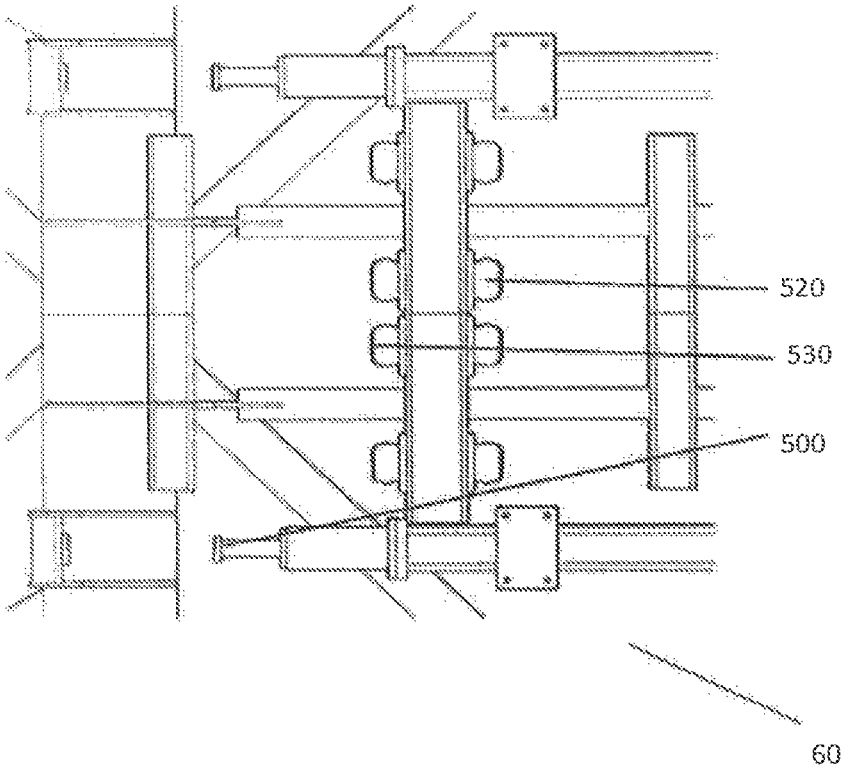
FIG. 13 is a top view illustrating the up-stop bumpers and down-stop bumpers of the pivot structure of the motion base of FIG. 3 in accordance with an embodiment of the invention.
Figure 14:
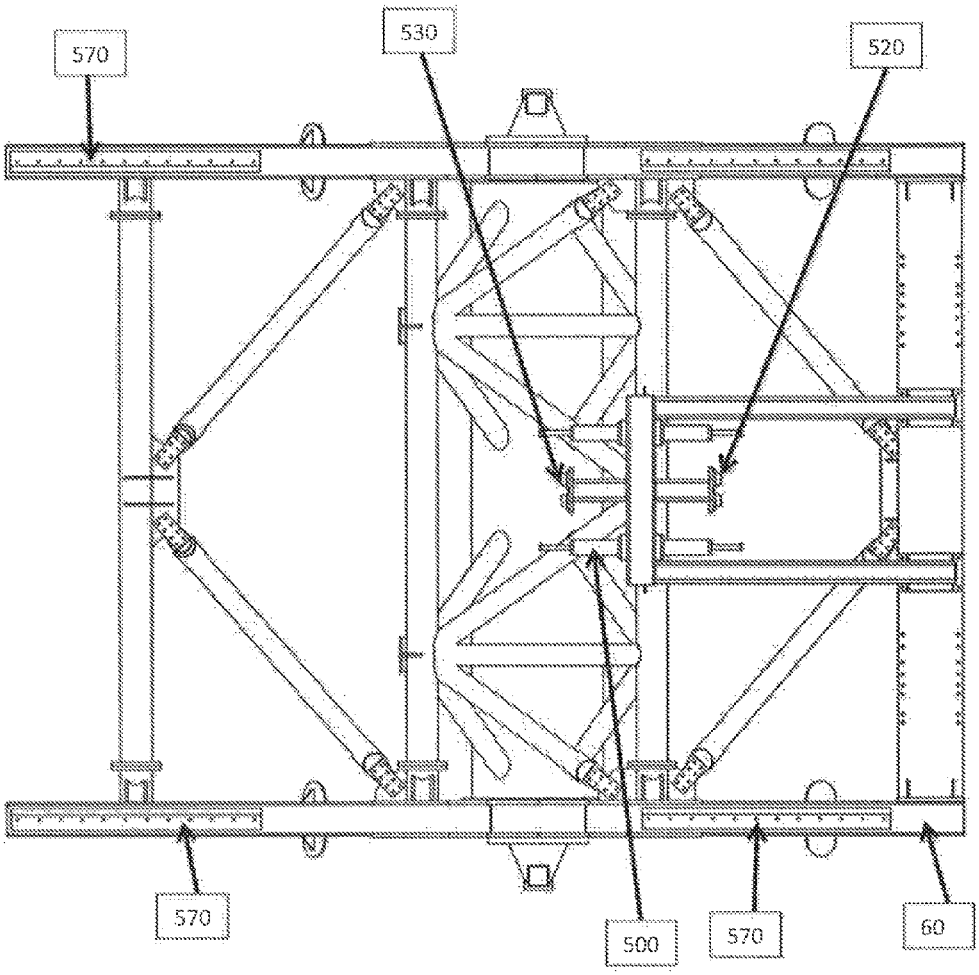
FIG. 14 is a top plan view of the pivot structure of the motion base of FIG. 3 in accordance with an embodiment of the invention.
Figure 15:
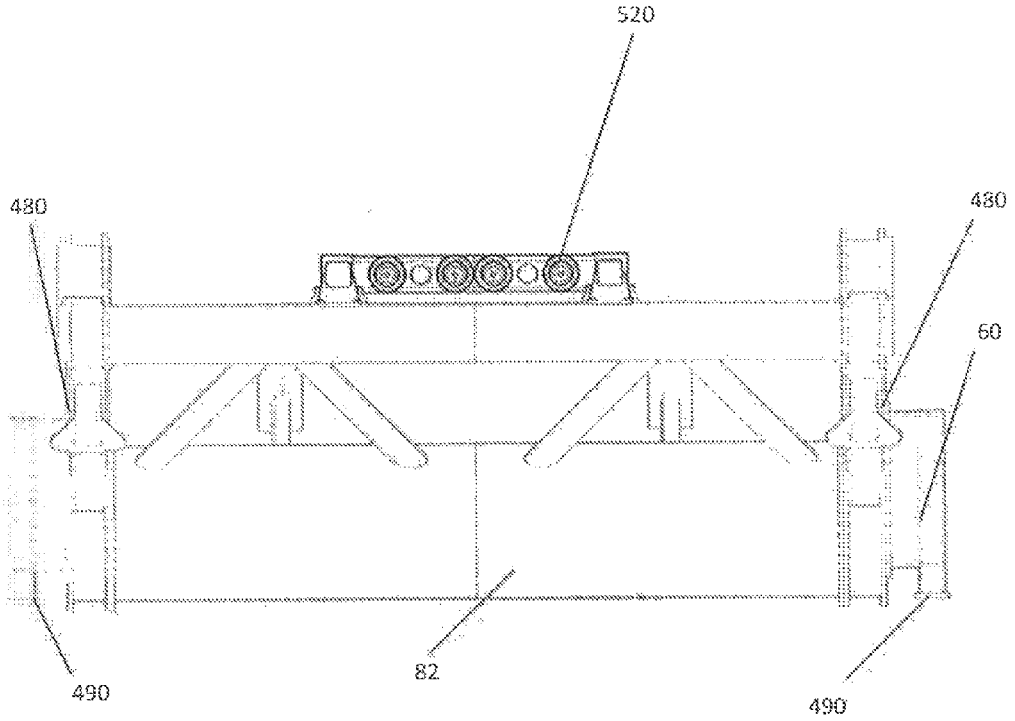
FIG. 15 is a front view illustrating the pivot structure of the motion base of FIG. 3 in accordance with an embodiment of the invention.

FIG. 12 is an isometric view illustrating the pivot structure 60 of the motion base 10 of FIG. 3 in a horizontal position 22 in accordance with an embodiment of the invention. FIG. 13 is a top view illustrating the up-stop bumpers 520 and down-stop bumpers 530 of the pivot structure 60 of the motion base 10 of FIG. 3 in accordance with an embodiment of the invention. FIG. 14 is a top plan view of the pivot structure 60 of the motion base 10 of FIG. 3 in accordance with an embodiment of the invention. FIG. 15 is a front view illustrating the pivot structure 60 of the motion base 10 of FIG. 3 in accordance with an embodiment of the invention.

As illustrated in FIGS. 12, 13, 14, and 15, the pivot structure 60 may optionally include shock absorbers 150. In one embodiment, eight shock absorbers 150 may be used with four acting in each direction, four as up-stop bumpers 520 and four as down-stop bumpers 530. In one embodiment, the shock absorbers 150 may be elastomeric shock absorbers. The shock absorbers 150 may be used to ensure the range of motion of the pivot structure 60 is kept within safe limits in case there is a loss of power or control of the actuator 130 and/or the counterbalancing member 140. The pivot structure 60 may further include a heave axis hard-stop 500 and a heave axis locking member 160 that keeps the platform 70 captive and maintains the range of motion of the platform 70 within safe limits, in the event of a loss of power or control of the actuator 130 and/or the counterbalancing member 140. The heave axis hard-stops 500 serve as a safety feature in that, in the case of loss of power or control of the actuator 130 and/or the counterbalancing member 140, they maintain the range of motion of the pivot structure 60 and the platform 70 along the heave axis 34 within safe limits. The heave axis locking members 160 mechanically lock-out the motion of the platform 70 along the heave axis 34 when they are engaged. This may be used as a safety feature when the platform 70 is stationary and in the horizontal position 22 during load/unload mode, or during maintenance.

The pivot structure 60 may optionally comprise a pivot axis hard stop 480 and a jacking stand 490. The jacking stand 490 provides support for a manual jack that can be inserted at the location of the jacking stand 490 and then used to manually lift the pivot structure 60 relative to the support structure 50 such that the driving member 90 can be temporarily removed if required for maintenance.

Figure 16:
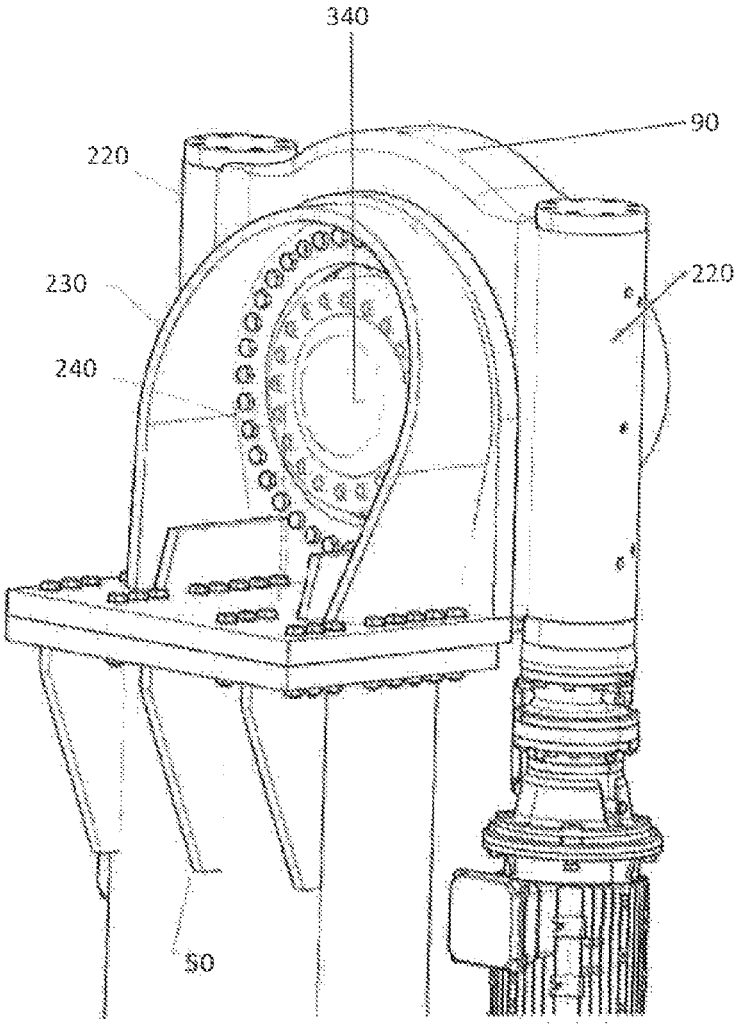
FIG. 16 is an isometric view illustrating the drive member of the motion base of FIG. 3 in accordance with an embodiment of the invention.

FIG. 16 is an isometric view illustrating the drive member 90 of the motion base 10 of FIG. 3 in accordance with an embodiment of the invention.

Figure 17:
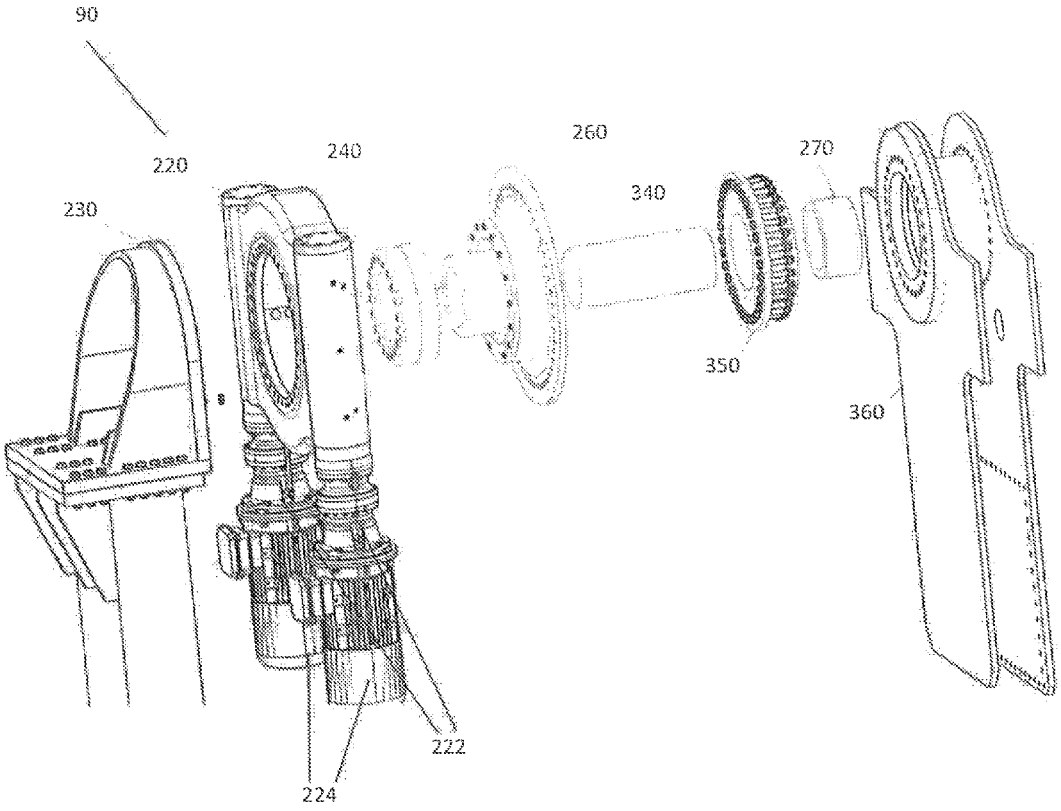
FIG. 17 is an exploded view illustrating the drive member of the motion base of FIG. 3 in accordance with an embodiment of the invention.
Figure 18:
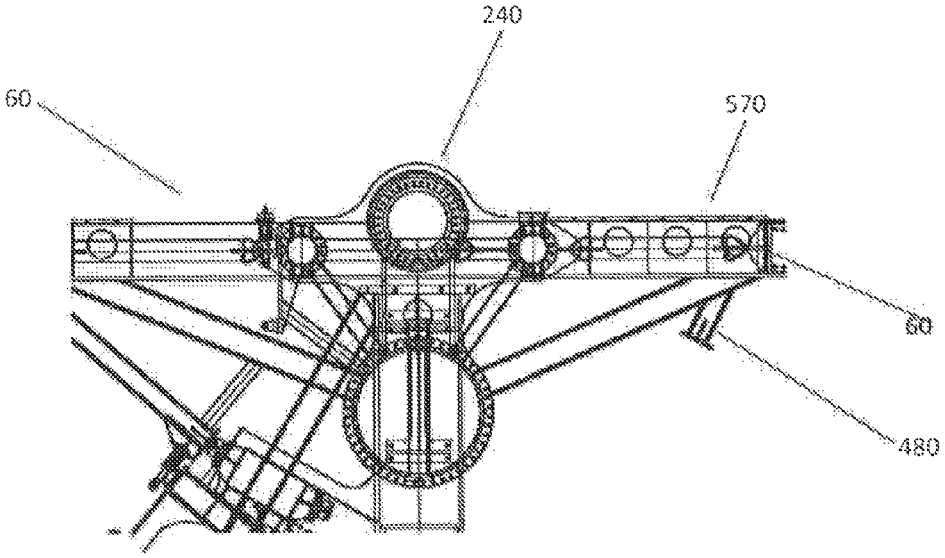
FIG. 18 is a side view illustrating the pivot structure of the motion base of FIG. 3 in a horizontal position in accordance with an embodiment of the invention.

FIG. 17 is an exploded view illustrating the drive member 90 of the motion base 10 of FIG. 3 in accordance with an embodiment of the invention. FIG. 18 is a side view illustrating the pivot structure 60 of the motion base 10 of FIG. 3 in a horizontal position 22 in accordance with an embodiment of the invention.

The drive member 90 facilitates rotation of the pivot structure 60 and the platform 70 through the shaft 340 at the pivot point 42. The drive member 90 may also include a shaft locking member 240 to lock the shaft 340 in place. The drive member 90 is mounted on the support structure 50 through a drive member mount 230. Fasteners 250 are used to lock different components of the drive member 90 in place. In one embodiment, the drive member 90 further comprises one pair of slew drives 220. In such embodiment, the slew drives 220 are driven by two worm gears, which in turn are each driven by a planetary gear box 222 and a gear box motor 224. In one embodiment, the drive member 90 further includes a worm gear that is configured to be back-drivable and the gear box motor 224 includes an integral brake. In other embodiments, one set of the slew drives 220 is provided on either side of the pivot structure 60.

According to one embodiment, the slew drive 220 drives the pivot structure 60 and the platform 70 via a shaft and gear coupling arrangement. The flexible coupling 260 releases axial and tilting moment degrees of freedom on the slew drives 220 in order to avoid over-constraint of the platform 70. The locking assembly 270 clamps the shaft 340 on the pivot structure 60 in order to transfer loads and torque. One side of the shaft 340 is rigidly connected to an internal hub 262 through the shaft locking member 240. In one embodiment, the shaft locking member 240 is a shrink disc. The internal hub 262 is then connected to the flexible coupling 260 which allows a certain amount of axial and rotational flexibility in order to accommodate any misalignment with respect to the shaft 340. The flexible coupling 260 is then connected to the driving member 90 which facilitates rotation of the shaft 340 and such rotation leads to rotation of the rotating frame 360. Movement of the rotating frame 360 then facilitates rotation of the pivot structure 60 coupled thereto (at the pivot points 42) and the platform 70 to allow the platform 70 of the motion base 10 to move from the horizontal position 22 to the vertical position 24.

As illustrated in FIG. 17, the drive member 90 facilitates rotation about the shaft 340 with the use of a rotating frame coupling 350 and a rotating frame 360. The rotating frame coupling 350, the rotating frame 360, and the shaft 340 are clamped together through the locking assembly 270. In one embodiment, the locking assembly 270 is a ringfeder.

Figure 19:
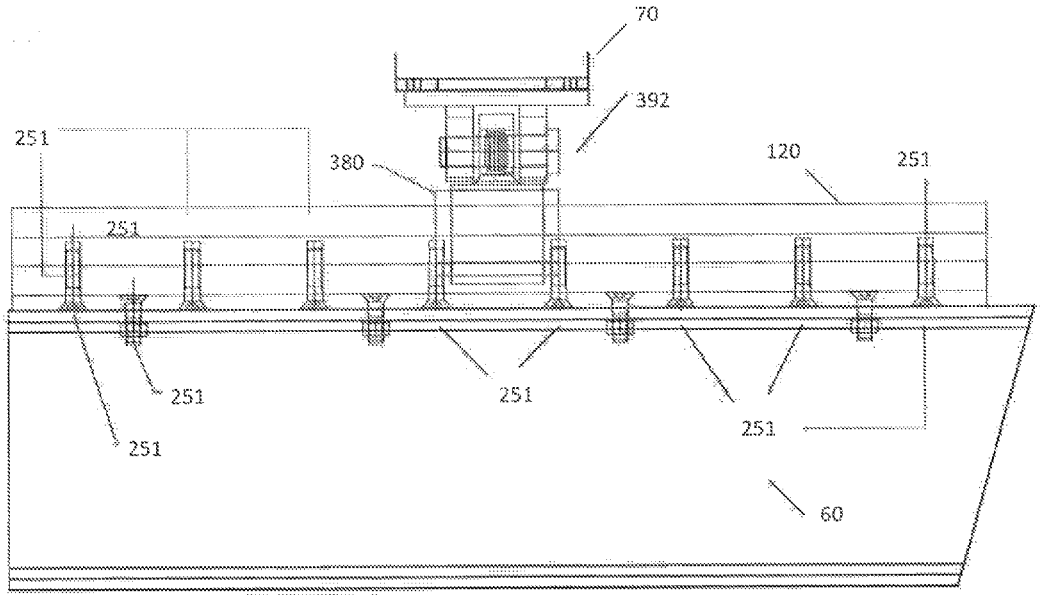
FIG. 19 is a side view illustrating the linear guide member of the motion base of FIG. 3 in accordance with an embodiment of the invention.
Figure 20:
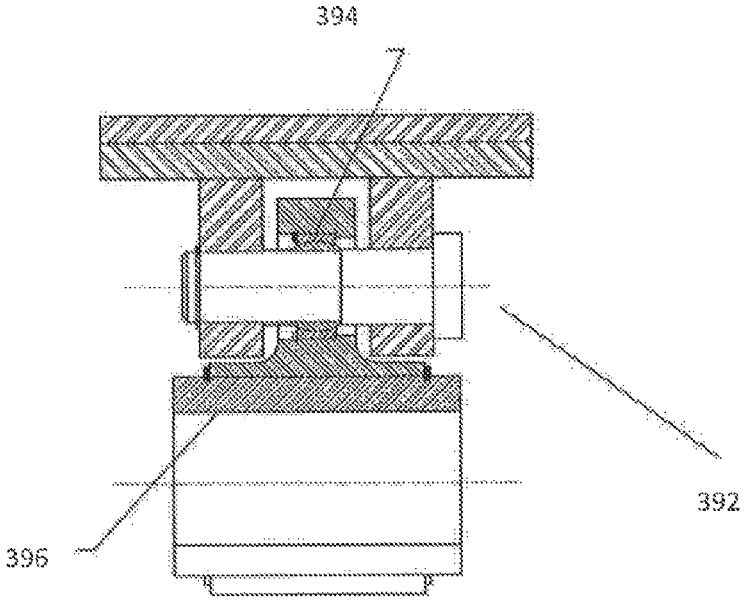
FIG. 20 is a cross-sectional view illustrating a hinge of the pivot structure of the motion base of FIG. 3 in accordance with an embodiment of the invention.
Figure 21:
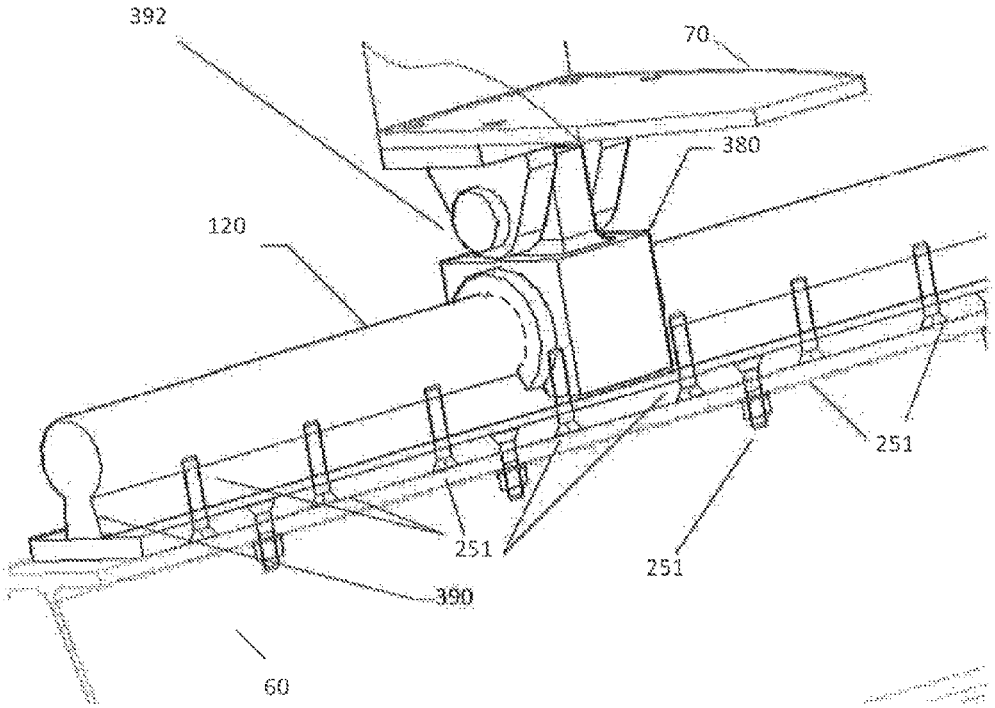
FIG. 21 is an isometric view illustrating the pivot structure of the motion base of FIG. 3 and its linear guide member, linear guide member support, hinge, and housing in accordance with an embodiment of the invention.
Figure 22:
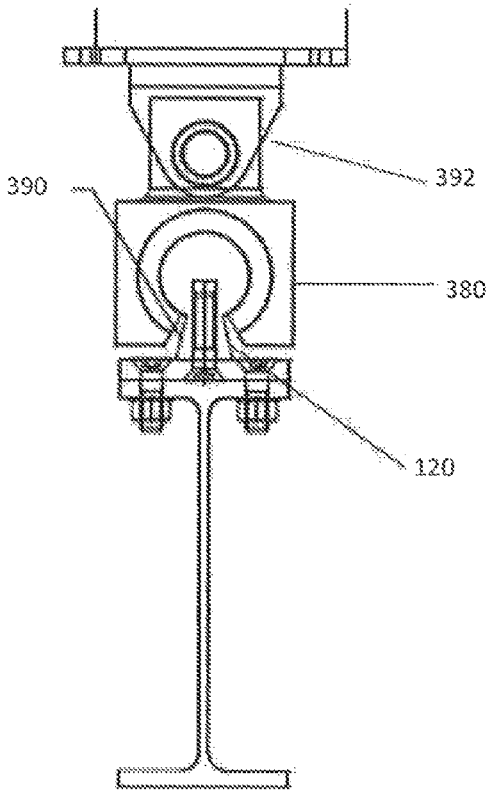
FIG. 22 is a side view illustrating the pivot structure of the motion base of FIG. 3 with its linear guide member, linear guide member support, hinge, and housing in accordance with an embodiment of the invention.

FIG. 19 is a side view illustrating the linear guide member 120 of the motion base 10 of FIG. 3 in accordance with an embodiment of the invention. FIG. 20 is a cross-sectional view illustrating a hinge 392 of the pivot structure 60 of the motion base 10 of FIG. 3 in accordance with an embodiment of the invention. FIG. 21 is an isometric view illustrating the pivot structure 60 of the motion base 10 of FIG. 3 and its linear guide member 392, linear guide member support 570, hinge 392, and housing 380 in accordance with an embodiment of the invention. FIG. 22 is a side view illustrating the pivot structure 60 of the motion base 10 of FIG. 3 with its linear guide member 392, linear guide member support 570, hinge 392, and housing 380 in accordance with an embodiment of the invention. In one embodiment, the linear guide member 120 comprises linear bearings. The linear guide member 120 is supported by the linear guide member support 390 and fastened onto the pivot structure 60 with fasteners 251. In one embodiment, a housing 380 is used to hold the platform 70 in place over the linear guide member 120 on the pivot structure 60. In other embodiments, the platform 70 can be held in place on the pivot structure 60 using a wheel and rail arrangement. In one embodiment, the hinge 392 uses a maintenance free spherical plain bearing 394 and self-lubricating bearing 396. The hinge 392 is used to avoid over-constraint of the pivot structure 60 laterally.

Figure 23:
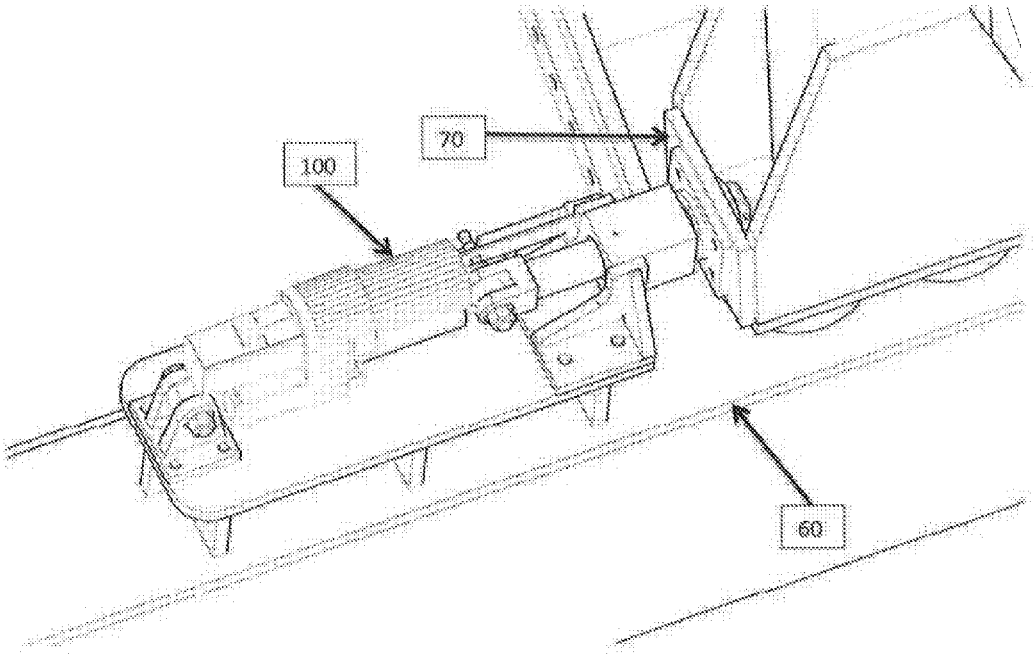
FIG. 23 is an isometric view illustrating the pivot axis locking member of the motion base of FIG. 3 in accordance with an embodiment of the invention.
Figure 24:
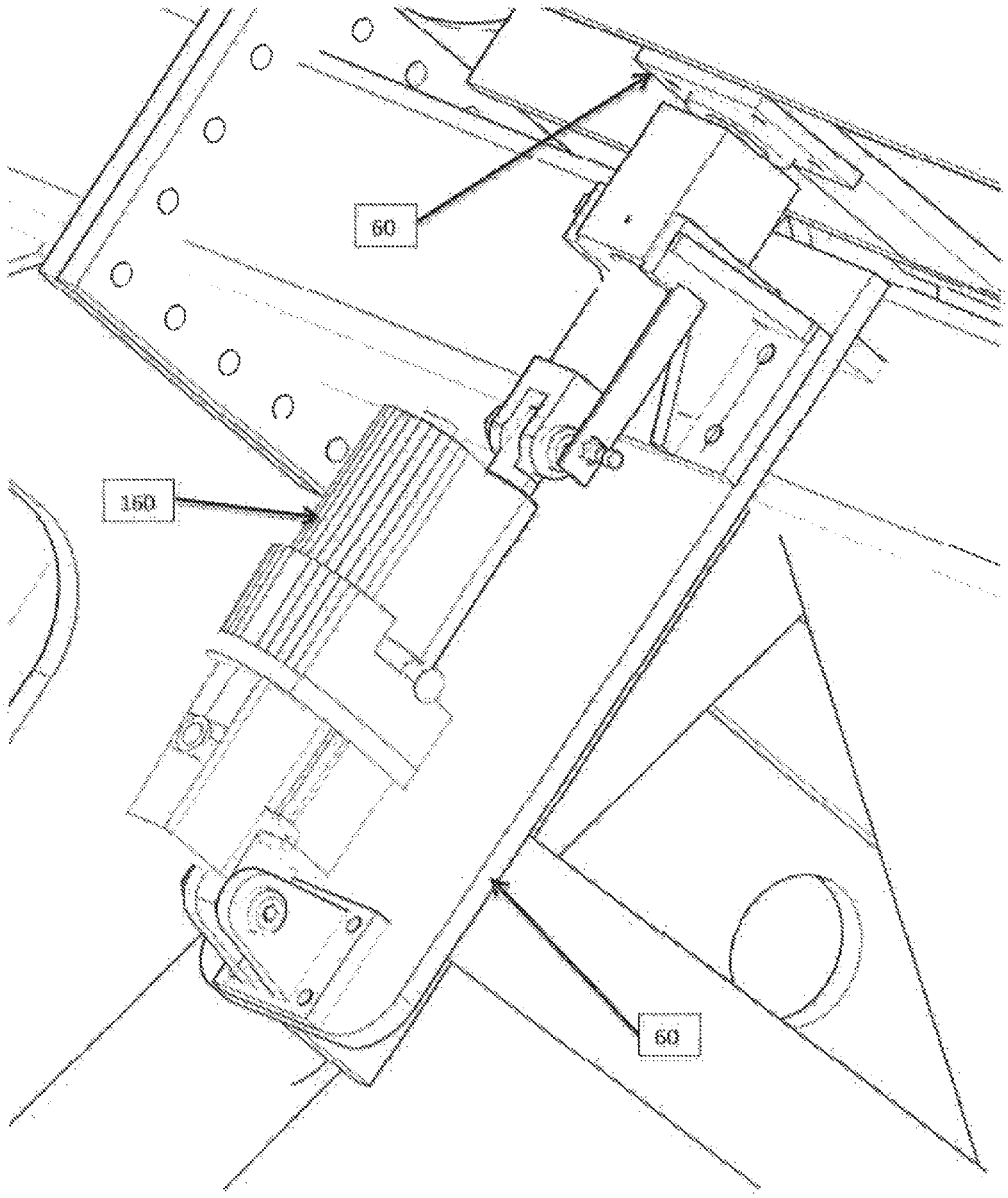
FIG. 24 is an isometric view illustrating the heave axis locking member of the motion base of FIG. 3 in accordance with an embodiment of the invention.
Figure 25A:
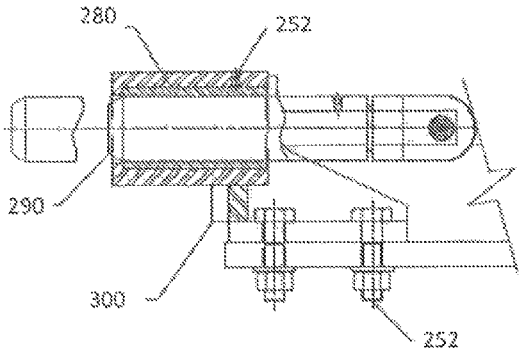
FIG. 25A is a cross-sectional view illustrating a docking pin for the pivot axis locking member and the heave axis locking member of the motion base of FIG. 3 in accordance with an embodiment of the invention.
Figure 25B:
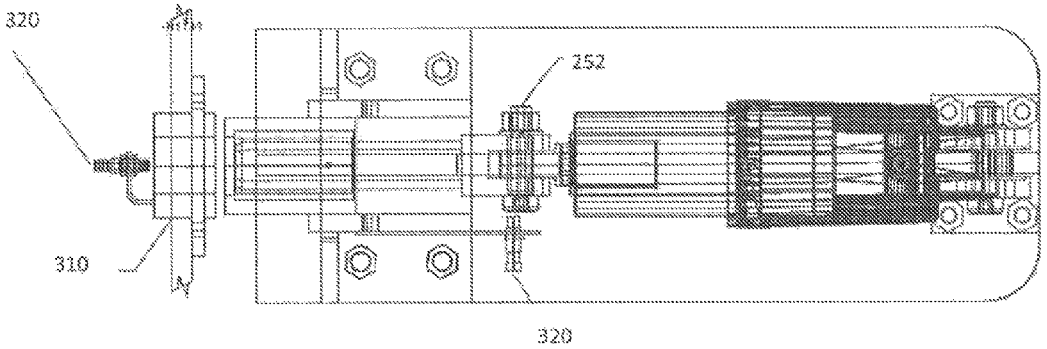
FIG. 25B is a top view illustrating the pivot axis locking member and the heave axis locking member of the motion base of FIG. 3 in accordance with an embodiment of the invention.
Figure 26:
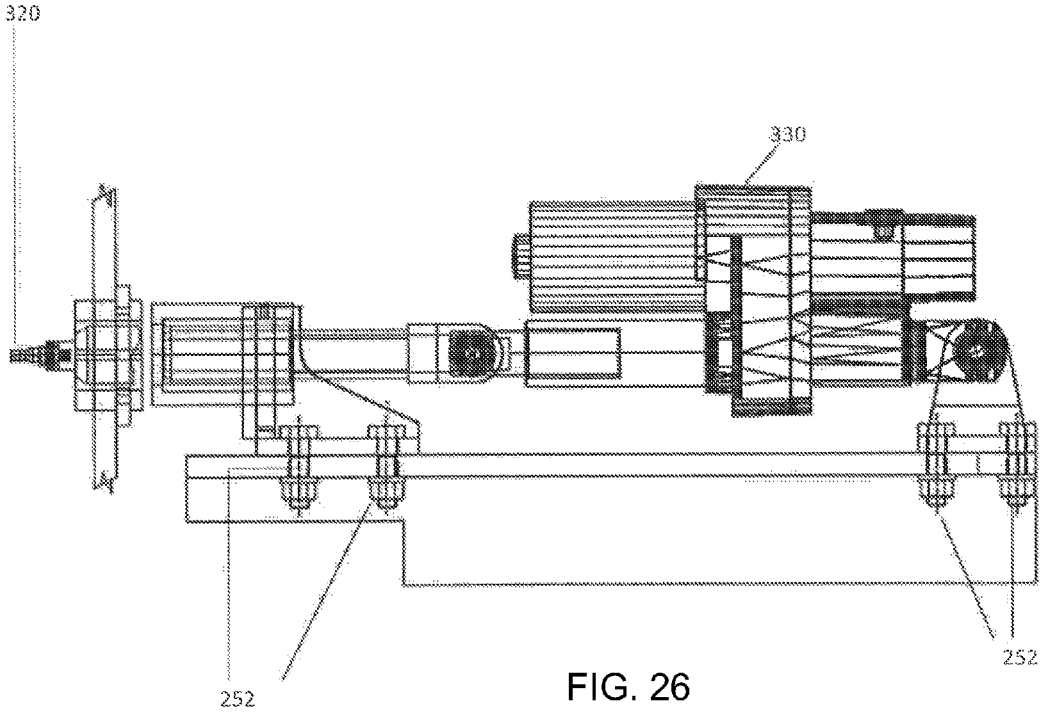
FIG. 26 is a side view illustrating the pivot axis locking member and the heave axis member of the motion base of FIG. 3 in accordance with an embodiment of the invention.

FIG. 23 is an isometric view illustrating the pivot axis locking member 100 of the motion base 10 of FIG. 3 in accordance with an embodiment of the invention. FIG. 24 is an isometric view illustrating the heave axis locking member 160 of the motion base 10 of FIG. 3 in accordance with an embodiment of the invention. FIG. 25A is a cross-sectional view illustrating a docking pin for the pivot axis locking member 100 and the heave axis locking member 160 of the motion base 10 of FIG. 3 in accordance with an embodiment of the invention. FIG. 25B is a top view illustrating the pivot axis locking member 100 and the heave axis locking member 160 of the motion base 10 of FIG. 3 in accordance with an embodiment of the invention. FIG. 26 is a side view illustrating the pivot axis locking member 100 and the heave axis member 160 of the motion base 10 of FIG. 3 in accordance with an embodiment of the invention.

The pivot axis locking member 100 and the heave axis locking member 160 are safety measures and are used to lock the platform 70 and the pivot structure 60 in place, respectively, in order to ensure the motion base 10 is held in a stationary position. In one embodiment, the pivot axis locking member 100 and the heave axis locking member 160 use a common locking member design. FIG. 25A and FIG. 25 B illustrate one embodiment of the design for the pivot axis locking member 100 and the heave axis locking member 160. The pivot axis locking member 100 and the heave axis locking member 160 each includes a proximity sensor 320, a receptacle 310, a docking pin actuator 330, and a docking pin 290. The docking pin 290 is held in place with a bracket 300, a bushing 280, and fasteners 252. The docking pin 290 slides inside the bushing 280 upon being actuated by the docking pin actuator 330. The pivot axis locking member 100 and the heave axis locking member 160 mechanically lock-out the motion of the motion base 10 around the pivot axis 32 and the heave axis 34 when they are engaged. In one embodiment, the docking pin actuator 330 is an electric cylinder actuator.

In one embodiment, when the platform 70 reaches the load/unload position, the docking pin 290 becomes aligned with an adjacent hole on the pivot structure 60. By extending the docking pin actuator 330, the docking pin 290 is extended into the hole and thus mechanically restricts the motion of the platform 70 along the heave axis 34. When the docking pin 290 is retracted, the platform 70 is free to move along the heave axis 34 again. This engagement may serve as a safety feature when the platform 70 is stationary during load/unload mode, or during maintenance to prevent any unwanted movement of the motion base 10 which may cause a safety concern.

In another embodiment, the locking function using the pivot axis locking member 100 and the heave axis locking member 160 is enhanced by position encoders. The position encoders may be used to indicate the exact position of the pivot axis 32 and heave axis 34 of the motion base 10 to the control system of the motion base 10. When the platform 70 of the motion base 10 moves from the vertical position 24 to the horizontal position 22, the control system will position the pivot structure 60 and the platform 70 to ensure the docking pin 290 of the pivot axis 32 locking member 100 and the heave axis locking member 160 aligns with the receptacle 310. The control system would then issue a command to the docking pin actuator 330 which in turn would push the docking pin 290 into its respective receptacle 310. The proximity sensor 320 then detects the engagement of the docking pin 290 and reports it to the control system.

Figure 27:
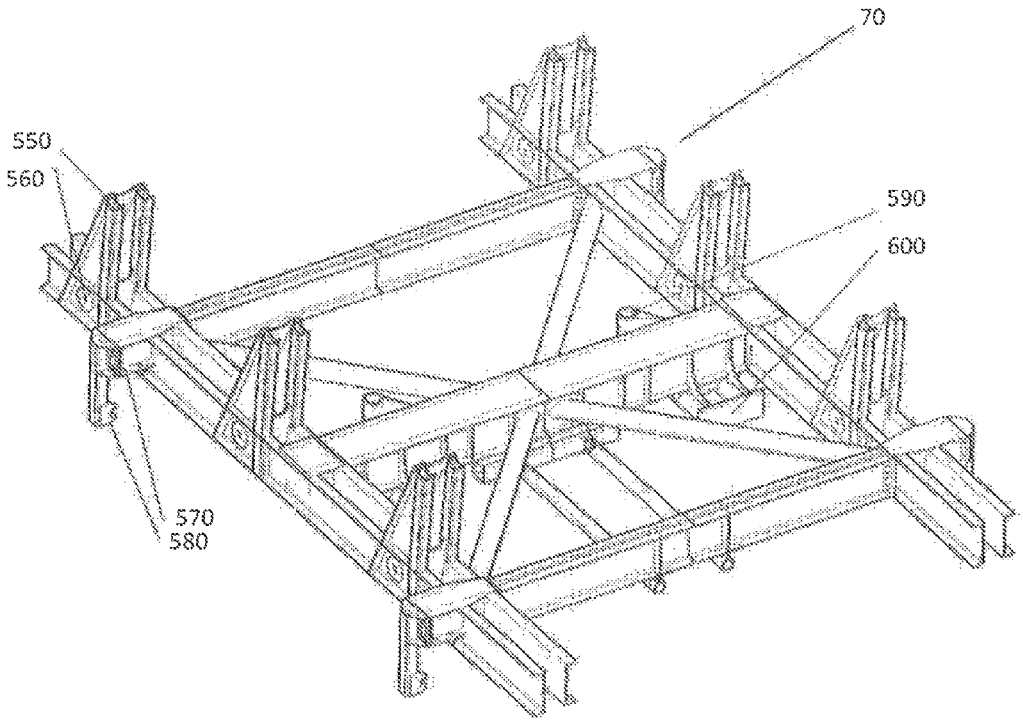
FIG. 27 is an isometric view illustrating the platform of the motion base of FIG. 3 in accordance with an embodiment of the invention.
Figure 28:
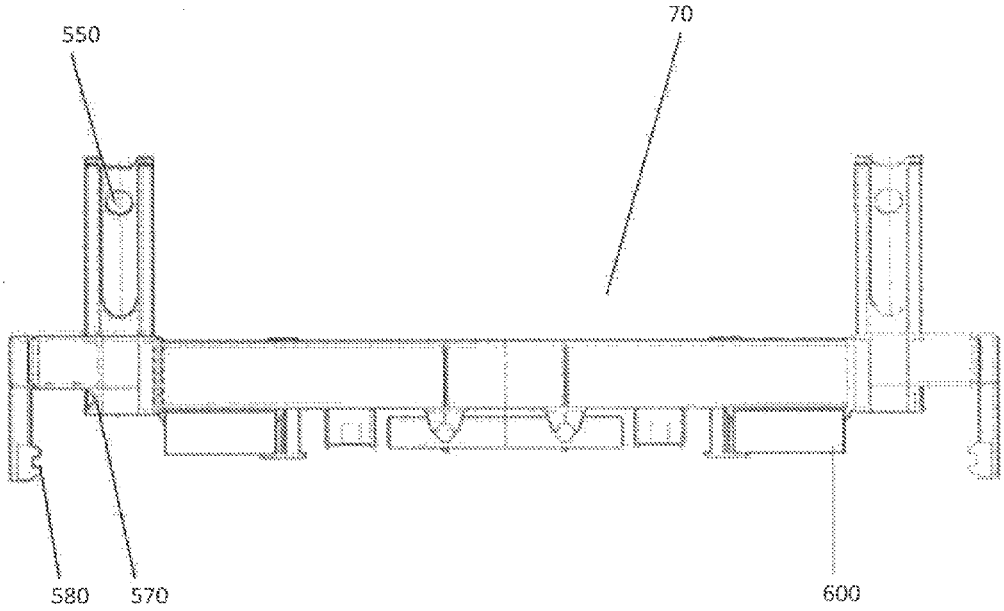
FIG. 28 is a front view illustrating the platform of the motion base of FIG. 3 in accordance with an embodiment of the invention.
Figure 29:
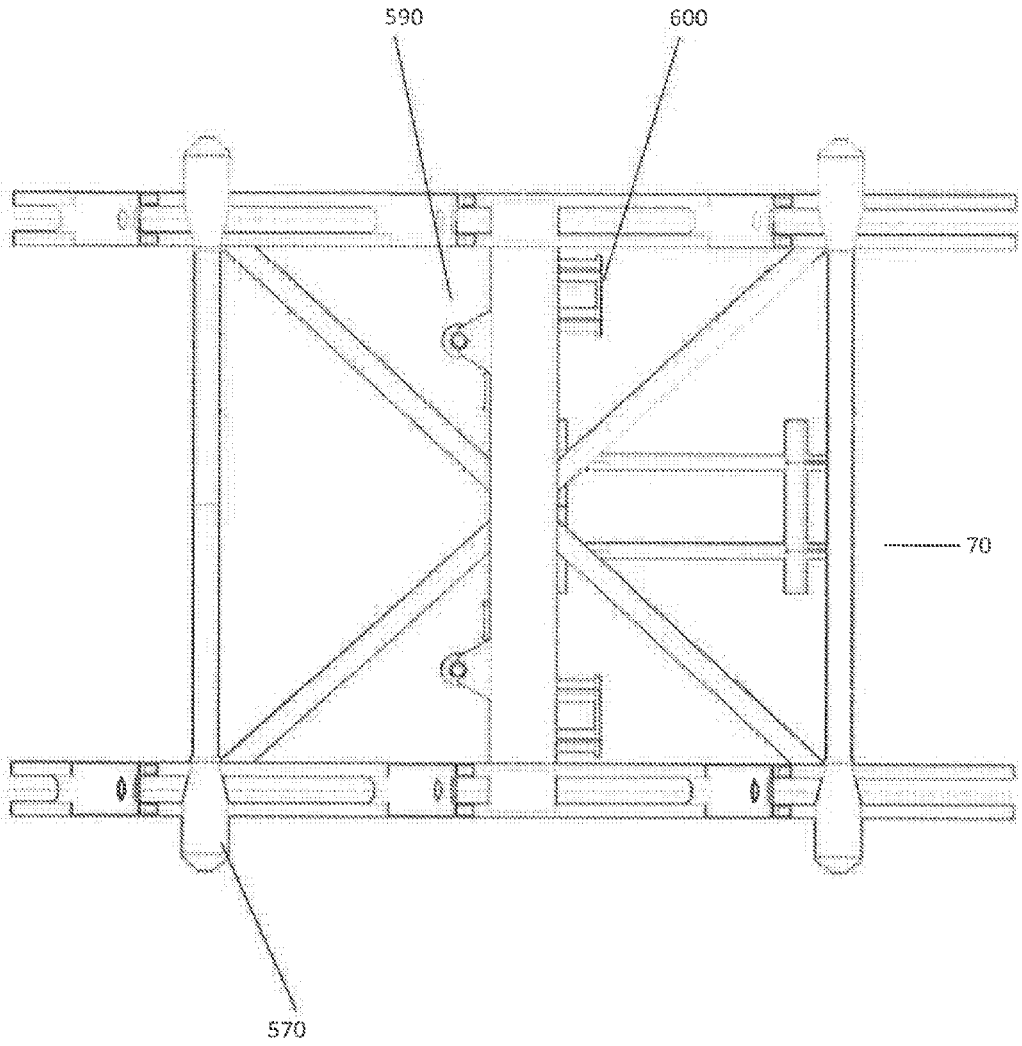
FIG. 29 is a top plan view illustrating the platform of the motion base of FIG. 3 in accordance with an embodiment of the invention.
Figure 30:
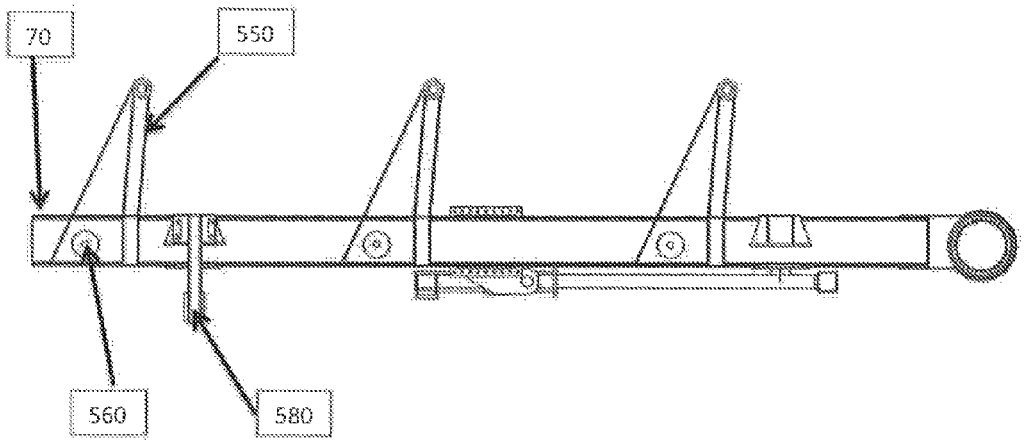
FIG. 30 is a side view illustrating the platform of the motion base of FIG. 3 in accordance with an embodiment of the invention.

FIG. 27 is an isometric view illustrating the platform 70 of the motion base 10 of FIG. 3 in accordance with an embodiment of the invention. FIG. 28 is a front view illustrating the platform 70 of the motion base 10 of FIG. 3 in accordance with an embodiment of the invention. FIG. 29 is a top plan view illustrating the platform 70 of the motion base 10 of FIG. 3 in accordance with an embodiment of the invention. FIG. 30 is a side view illustrating the platform 70 of the motion base 10 of FIG. 3 in accordance with an embodiment of the invention.

The pivot structure 60 supports and allows rotation and sliding of the platform 70. In one embodiment, the platform 70 includes a seat pitch bearing support 550, a seat pitch crank support 560, a linear guide member mounting flange 570, a hard stop bracket 580, an actuator and a counterbalance motor mounting flange 600, and a heave axis locking member bracket 590. The linear guide member mounting flanges 570 are the mounting surfaces for the linear guide member 120 which is mounted on the pivot structure 60. The seat pitch bearing support 500 and the seat pitch crank support 560 are used for interaction with seat pitch adjustment mechanisms to allow the seats 80 to move with movement of the platform 70. The seat pitch bearing support 550 supports the main seat pitch axis 36 that the rows of the seats 80 are connected to. The seat pitch crank support 560 supports the main pivoting axis of the seat pitch crank 450. The hard stop bracket 580 provides a secondary restraint for the platform 70 in case of failure of the linear guide members 120 and assists with holding the platform 70 in place over the pivot structure 60. The actuator and counterbalance mounting flange 600 provides the location where the actuator 130 and counterbalancing member 140 are coupled to the platform 70. The heave axis locking member bracket 590 provides a location for the heave axis locking member 160 to engage.

Figure 31:
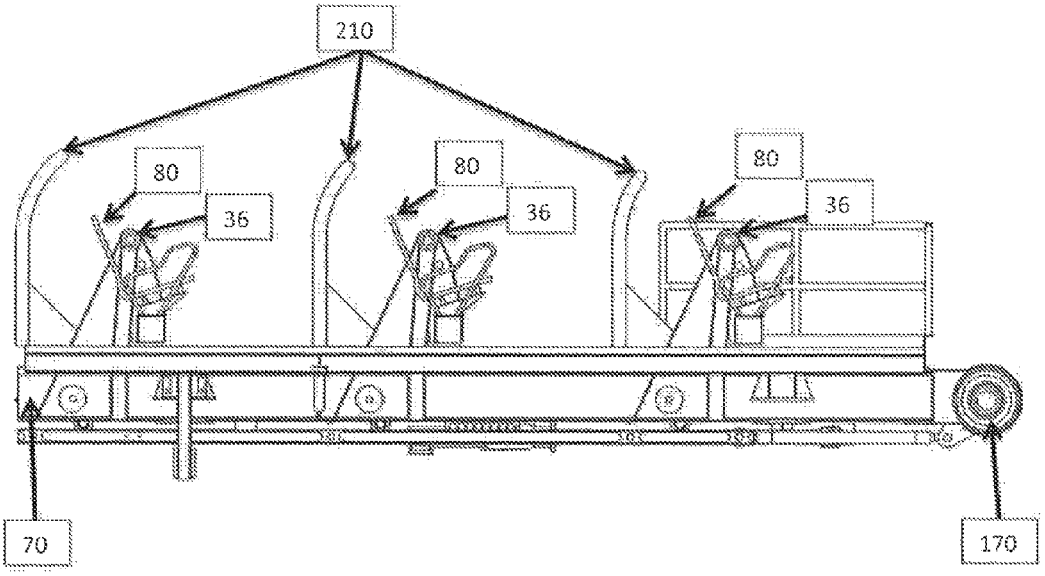
FIG. 31 is a side view illustrating the seats on the platform of the motion base of FIG. 3 in a horizontal position in accordance with an embodiment of the invention.
Figure 32:
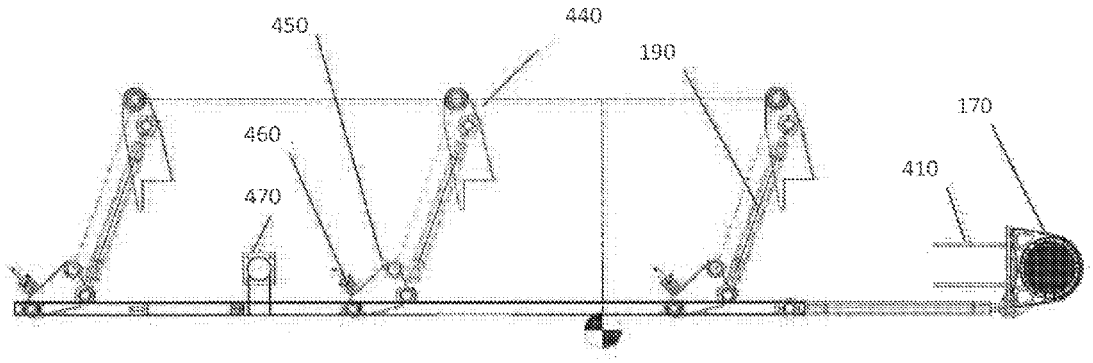
FIG. 32 is a side view illustrating the seats and canopies behind the seats on the platform of the motion base of FIG. 3 in a horizontal position in accordance with an embodiment of the invention.
Figure 33:
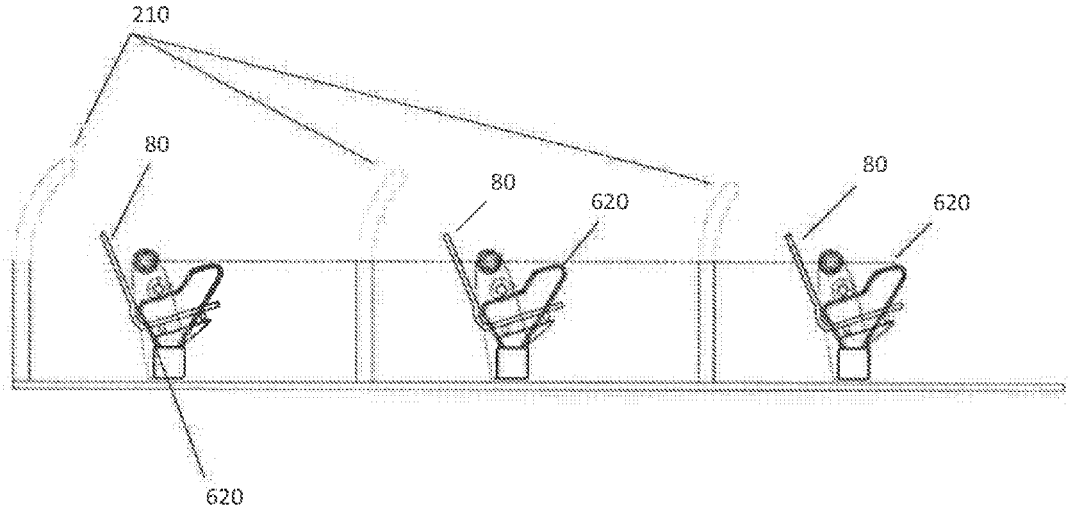
FIG. 33 is a side view illustrating the platform of the motion base of FIG. 3 in a horizontal position in accordance with an embodiment of the invention.
Figure 34:
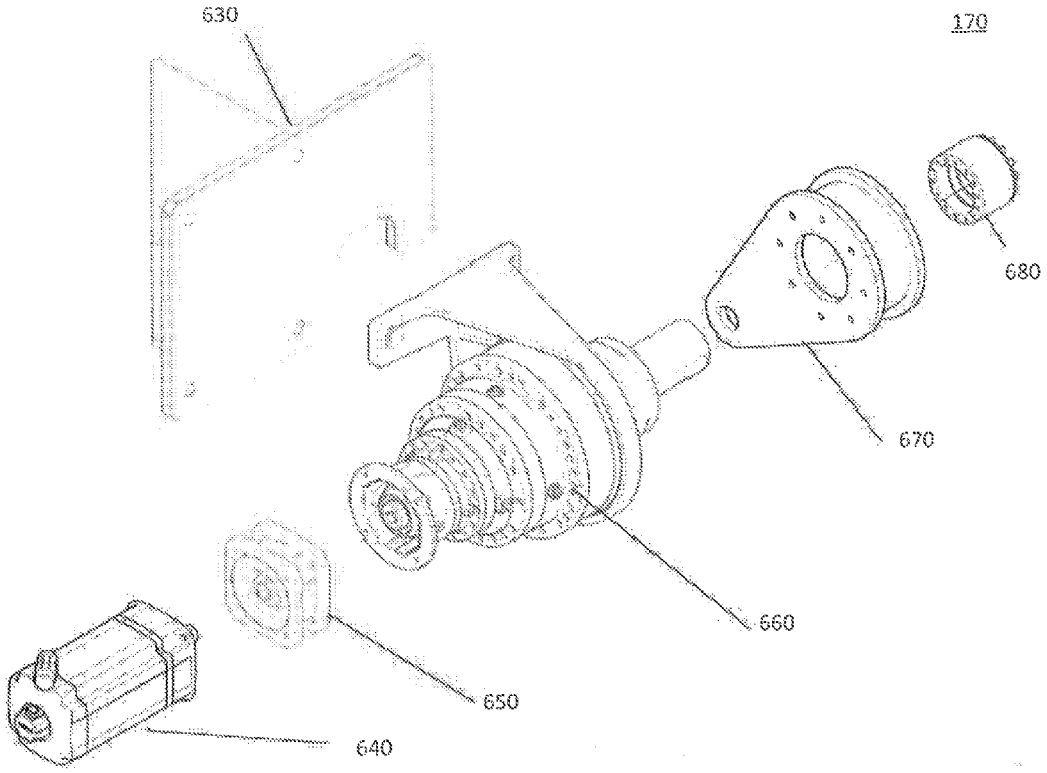
FIG. 34 is an exploded view illustrating the seat drive member of the motion base of FIG. 3 in accordance with an embodiment of the invention.

FIG. 31 is a side view illustrating the seats 80 on the platform 70 of the motion base 10 of FIG. 3 in a horizontal position in accordance with an embodiment of the invention. FIG. 32 is a side view illustrating the seats 80 and canopies 210 behind the seats 80 on the platform 70 of the motion base 10 of FIG. 3 in a horizontal position 22 in accordance with an embodiment of the invention. FIG. 33 is a side view illustrating the platform 70 of the motion base 10 of FIG. 3 with its platform 70 in a horizontal position in accordance with an embodiment of the invention. FIG. 34 is an exploded view illustrating the seat drive member 170 of the motion base 10 of FIG. 3 in accordance with an embodiment of the invention.

The seat drive member 170, the seat actuating member 180, and the seat drive linkage 190 are responsible for driving the seats 80 so that the seats 80 move into a generally vertical position when the platform 70 of the motion base 10 moves from the horizontal position 22 to the vertical position 24. In one embodiment, the seat drive linkage 190 is connected to each row of the seats 80. The seat drive linkage 190 drives seat pitch cranks 450 to effect changes to the pitch of the seats 80. The seats 80 are mounted on the platform 70 with seat frame brackets 440. In another embodiment, the seat drive member 170 is mounted on the platform 70 through the driving member mounting frame 410.

As the platform 70 of the motion base 10 moves from the horizontal position 22 to the vertical position 24, through the seat driver member 170, the pitch of the seats 80 is correspondingly controlled such that the seats 80 maintain an approximately level orientation during this motion. The seat pitch axis 36 of the seats 80 may tilt forward or rearward slightly relative to a level orientation in order to enhance the dynamic effects of the motion base 10 for the guests.

In another embodiment, seat pitch stops 200 may be used to prevent movement beyond permitted parameters. In another embodiment, forward travel stops 460 and backward travel stops 470 may be used for stopping the change in pitch of the seats 80. In another embodiment, the seat pitch stops 200, forward travel stops 460, and backward travel stop 470 may be elastomeric shock absorbers.

As illustrated in FIG. 33, in one embodiment, the seats 80 may also be equipped with handrails 620 to provide guests with support when entering and exiting the seats 80. In another embodiment, the seats 80 may include a restraint (not shown). The restraint may optionally be anchored to the main support to which the seats 80 are anchored. In another embodiment, the restraint may include a locking reel and a locking buckle. In another embodiment, the restraint may be fed through a crotch-strap to prevent submarining.

In another embodiment, canopies 210 may be placed behind the seats 80. The canopies 210 are designed to be non-intrusive when the platform 70 of the motion base 10 is in the horizontal position 22 during which guests are loading and unloading onto the platform 70. The canopies 210 provide a sight block for guests when the platform 70 of the motion base 10 is in the vertical position 24. In one embodiment, the canopies 210 are passively deployed behind the seats 80. In other embodiments, the canopies 210 are actively deployed from within the platform 70 when the platform 70 of the motion base 10 moves from the horizontal position 22 to vertical position 24. In one embodiment, the canopies 210 may include special effects such as fans for a wind effect or devices for scent distribution.

The seat drive member 170 is responsible for changing the pitch of the seats 80 when the platform 70 of the motion base 10 moves from the horizontal position 22 to the vertical position 24. In one embodiment, the seat drive member 170 includes a servomotor 640, a dynamic brake 650, a planetary reducer 660, a crank 670, and a seat drive member bushing 680. In one embodiment, the seat drive member 170 is mounted onto the platform 70 with the mounting bracket 630. The servomotor 640 and the planetary reducer 660 assembly drive the tilting of the seats 80 relative to the platform 70 via the seat drive linkage 190 through use of the crank 670 that is connected to the planetary reducer 660 with the bushing 680. The dynamic brake 650 serves to hold the position of the servomotor 640 when the servomotor 640 is not in use.

Due to the flexibility of the motion base 10, the motion base 10 may be used in theatres 1 having a variety of different designs and screens 20. In one embodiment, the screen 20 may be a flat rectangular screen.

Figure 35:
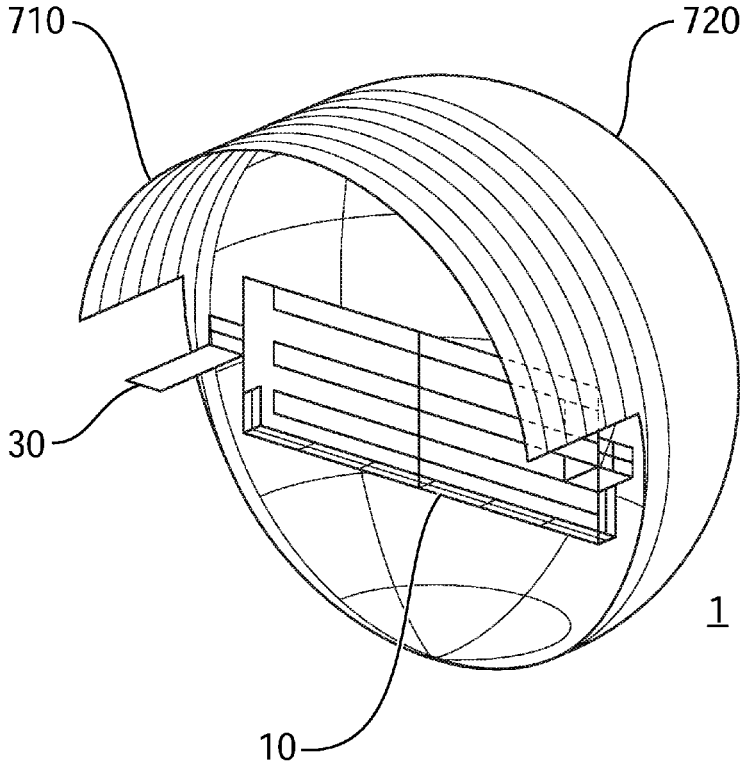
FIG. 35 is an isometric view illustrating the motion bases of FIG. 1 in a theatre having a hemispherical screen in accordance with an embodiment of the invention.
Figure 36A:
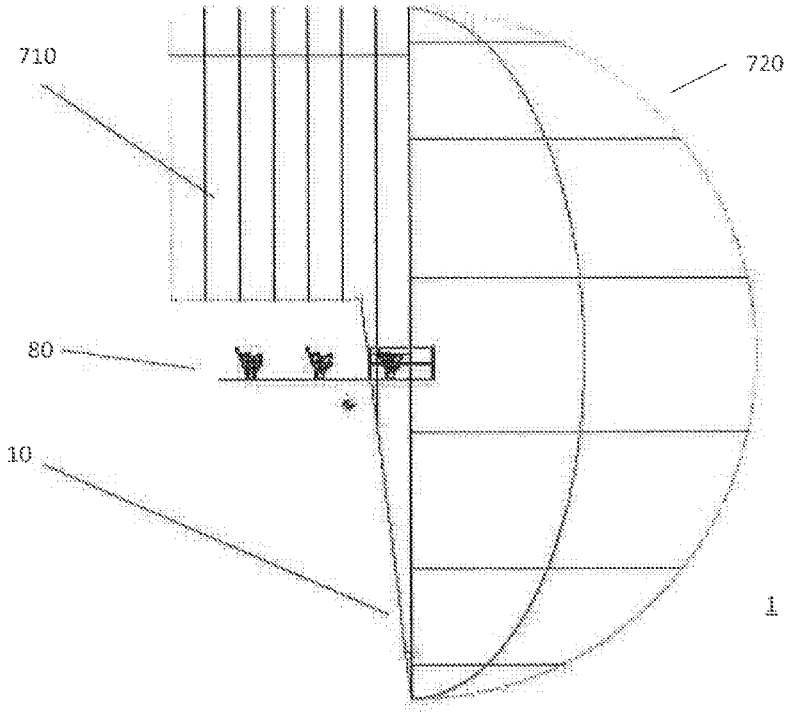
FIG. 36A is a side view illustrating the motion bases of FIG. 1 with their platforms in a horizontal position in a theatre having a hemispherical screen in accordance with an embodiment of the invention; and, FIG. 36B is a side view illustrating the motion bases of FIG. 1 with their platforms in a vertical position in a theatre having a hemispherical screen in accordance with an embodiment of the invention.
Figure 36B:
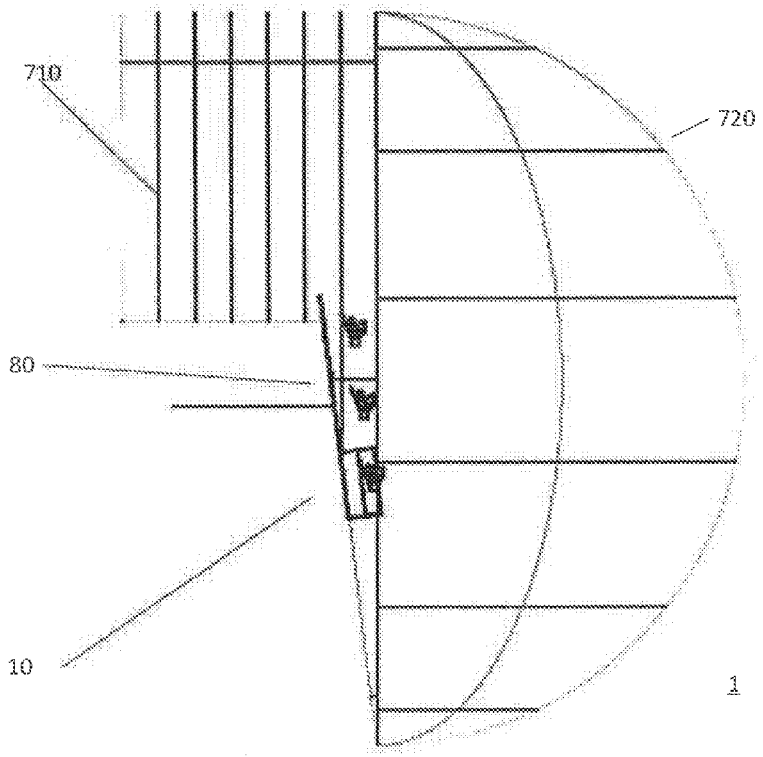

FIG. 35 is an isometric view illustrating the motion bases 10 of FIG. 1 in a theatre 1 having a hemispherical screen 720 in accordance with an embodiment of the invention. FIG. 36A is a side view illustrating the motion bases 10 of FIG. 1 with their platforms 70 in a horizontal position 22 in a theatre 1 having a hemispherical screen 720 in accordance with an embodiment of the invention. FIG. 36B is a side view illustrating the motion bases 10 of FIG. 1 with their platforms 70 in a vertical position 24 in a theatre 1 having a hemispherical screen 720 in accordance with an embodiment of the invention.

In another embodiment, the screen 20 may be a hemispherical screen 720 that envelops the viewable area of guests situated on the seats 80 of the motion base 10. In another embodiment, the screen 20 may be a hemispherical screen 720 with a cylindrical screen extension 710. The cylindrical screen extension 710 allows the hemispherical screen 720 to be extended overhead of the guests in the seats 80. In one embodiment, when the platform 70 of the motion base 10 is in the horizontal position 22, images may be projected onto the cylindrical screen extension 710 and the seats 80 may be pitched backwards. As the platform 70 of the motion base 10 changes from the horizontal position 22 to the vertical position 24, the location of the projected images may be transitioned from being overhead of the guests to being in front of the guests in the center of the hemispherical portion of the hemispherical screen 720. In combination, the hemispherical screen 720 and the cylindrical screen extension 710 provides a geometrically smooth transition in surface shape from the hemispherical to the cylindrical portions. The cylindrical screen extension 710 is also designed to ensure that the platform 70 of the motion base 10 can properly move between the horizontal position 22 and the vertical position 24 without encumbrance.

In one embodiment, guests may be first shown an outer-space based movie in the theatre 1, for example. As the movie progresses, the movie would zoom into earth, and then zoom into the location on earth where the movie is set. The zooming in occurs in conjunction with the platform 70 of the motion base 10 moving from the horizontal position 22 to the vertical position 24.

Operation of the motion base 10 may be controlled through use of a ride control system. The ride control system may comprise the ride control sub-system controller, operator control consoles, human machine interfaces, feedback devices mounted on the platform 70, the pivot structure 60, and the support structure 50, motion controllers, and hard-wired emergency stop circuits.

The ride control system may be designed to move the motion base 10 in a smooth and flowing motion when moving the platform 70 from the horizontal position 22 to the vertical position 24.

In one embodiment, the ride control system may include an uninterrupted power supply that will support the controls to return the platform 70 of the motion base 10 to the horizontal position 22 and, as such, the seats 80 to the load/unload position in the event of a loss of power to the theatre 1.

A ride control subsystem controller commonly known to persons skilled in the art may be used for control of the motion base 10. In one embodiment, the ride control subsystem controller may be an Allen-Bradley GuardLogix safety controller. The GuardLogix controller comprises a standard ControlLogix processor and a redundant safety partner processor which function together in a 1oo2 architecture. The GuardLogix system supports SIL3 and Category 4 safety applications.

The ride control system may also employ safety modules that control hardwired safety protocols. In one embodiment, the ride control system uses DeviceNet Safety I/O modules and a DeviceNet safety network for hardwired interface to safety-related inputs and outputs.

The ride control system may use network protocols commonly known to persons skilled in the art to communicate with controllers on the motion base 10 to receive, transmit, or communicating status and diagnostic information. In one embodiment, the ride control system may use a wireless Ethernet network for communications to ride vehicle subsystem controllers.

In one embodiment, redundant rotary encoders mounted on each pivot point 42 in the motion base 10 may provide primary and secondary position feedback.

Emergency stop buttons may also be used to ensure the motion base 10 can be stopped in the case of emergency. In one embodiment, manual emergency stop buttons are positioned on all control consoles and at strategic locations throughout the theatre 1 and the motion base 10. In one embodiment, the emergency stop push buttons have two contacts each and are wired in series to form a dual-chain Cat 4/SIL-3 safety circuit. Any interruption of the emergency stop circuit will result in a safe stop of the motion base 10 in isolation of all power sources. In other embodiments, the emergency stop may only be reset at the main operator control console, and after an emergency stop, the motion base 10 may be programmed to return the platform 70 to the horizontal position 22 so as to allow guests to leave the seats 80 and the theatre 1.

Operator control consoles may be used by operators to control the movement of the motion base 10 and corresponding shows being shown in the theatre 1. A primary operator control console may be located at a main operator booth, in the load area, or in the unload area.

A main operator control booth human machine interface panel may be used to display relevant information relating to the motion base 10 and the theatre 1 in general. In one embodiment, the main operator booth human machine interface panel displays alarm, status and diagnostic information. In other embodiments, the panel comprises the following additional screens: overview screen of the entire attraction with general status information, detailed status screens, emergency stop status screen, network status screen, startup screen, alarm screen, alarm history screen, ride mode, state of the motion base 10, time, and date.

In other embodiments, the human machine interface panel displays alarm messages that may include the following fields: time and date, alarm ID (i.e., unique alpha-numeric code for each alarm), device ID (i.e., unique alpha-numeric code for each device), component ID (e.g., code to indicate sensor, motor, valve, brake, etc. and to identify which component was the source of the alarm), consequence (e.g., emergency stop, dispatch, inhibit, ride stop, etc.), diagnostic message, or recovery procedure.

In other embodiments, the ride control system may comprise a database that stores up to four (4) months of fault messages. In yet other embodiments, the database server may also be equipped with tape back-up capability for all diagnostic messages, including required tape back-up recording hardware and software.

The ride control system may also contain an event logging feature that logs each operator request, control actuation and change of state of the motion base 10. In one embodiment, these messages do not appear on the human machine interface panel and are not accessible from the panel. In other embodiments, the messages are loaded into a data circular buffer that over-writes itself every seventy-two (72) hours. In the event of an alarm, the ride control system may publish event messages with the following fields for each alarm: time and date, event ID (i.e., a unique alpha-numeric code for each event), device ID (i.e., a unique alpha-numeric code for each device), component ID (i.e., a code to indicate sensor, motor, valve, brake, etc., and to identify which component was the source of the event), change of state, modes of operation (which may include maintenance mode, load/unload mode, evacuation mode, and automatic mode).

In one embodiment, the ride control sub-system controller determines the current mode of the motion base 10 and its subsystems. Operations or maintenance personnel may select the mode of operation at the main operator control console.

In one embodiment, a maintenance mode is provided which is a mode for maintenance personnel only and allows for manual control of ride devices. The devices must be within line-of-sight of the controlling position to manually operate. All emergency stop pushbuttons would be operational in maintenance mode. A load/unload mode may be used during guest loading and unloading onto the seats 80. To enter load/unload mode, the platform 70 of the motion base 10 will be in the horizontal position 22 to allow for the load/unload position. In this mode, all power sources are safely isolated from the motion base 10 to prevent any motion during the load/unload process.

In another embodiment, the motion base 10 may be placed into an evacuation mode. Evacuation mode is used to return the platform 70 of the motion base 10 to the horizontal position 22 to allow for the load/unload position in the event of a component failure that prevents automatic operation of the motion base 10. Evacuation mode may include automatic sequences to assist operations personnel with the evacuation procedures. All emergency stop pushbuttons may be operational in evacuation mode.

During normal operation of the motion base 10, the motion base 10 may be placed in an automatic mode. All motion in automatic mode is performed under the supervision of the ride control system. To enter automatic mode, the platform 70 of the motion base 10 must be in the horizontal position 22, guest seat restraints are locked and confirmed, and no ride control system faults are present. The motion base 10 may only operate with the show in the theatre 1 during automatic mode. All emergency stop pushbuttons may be operational in automatic mode.

The above embodiments may contribute to an improved motion base 10 and may provide one or more advantages. First, the pivot structure 60 is nearly balanced so as to reduce the mechanical load requirements to pivot the pivot structure 60. Second, seat pitch mechanisms allow multiple seats to be driven by a single drive unit to minimize the number of drives required. Third, the canopies 210 provide sight blocks so that guests' line of sight to the top of the screen 20 is restricted, thus eliminating any stationary building or ceiling structure from their field of view. Fourth, the canopies 210 stop falling objects or debris from upper rows of the platform 70 from landing on the heads of the guests in the lower rows. Fifth, modular design of the motion base 10 provides for reduced costs of components and reduced costs of maintenance. Sixth, the pivot structure 60 and the platform 70 provide an efficient load path which in turn requires less mechanical demand. Seventh, the motion base 10 may provide less load on the structure and foundation of the theatre 1. Eighth, pivot mechanisms are hidden from guests so as to create an element of surprise when guests board the platform 70 of the motion base 10. Ninth, efficient load bearing allows reliable and low-maintenance electric actuators to be used instead of heavy hydraulic systems. An electric solution eliminates the need for large, noisy and maintenance intensive hydraulic power units, valve gear and actuators, negating the need for a dedicated equipment room and noise suppression systems.

The embodiments of the invention described above are intended to be exemplary only. Those skilled in this art will understand that various modifications of detail may be made to these embodiments, all of which come within the scope of the invention.

What is claimed is:

1. An amusement ride assembly comprising:

a motion base comprising:

a stationary support structure having a first end and a second end, the first end engaging a support surface and the second end having first pivot means;

a pivot structure comprising;

second pivot means rotatably engageable with the first pivot means about a pivot axis located adjacent the center of gravity of the pivot structure;

a platform having a transverse axis, the platform oriented in a first plane and supported by the second pivot means and having an upper surface and a lower surface, the lower surface of the platform slidably engaged with the second pivot means such that the platform is translatable linearly along a longitudinally extending heave axis, the heave axis aligned orthogonally to the transverse axis and aligned coplanarly with the first plane, the platform comprising:

at least two seats arranged longitudinally along the platform, each of the at least two seats having an upper first end and a lower second end, each of the at least two seats having seat pivot means;

at least one seat frame bracket attached to the upper surface of the platform and rotatably engaging the seat pivot means of each of the at least two seats about a seat pitch axis of each of the at least two seats;

at least one canopy transversely extending across the platform and oriented between the at least two seats;

a seat drive member;

at least one seat actuating member engaging each of the at least two seats longitudinally at a position adjacent the centre of gravity of each of the at least two seats, the at least one seat actuating member operably connected to the seat drive member such that pitch of each of the at least two seats is rotatable about the seat pitch axis when the seat drive member engages the seat actuating member; and at least one actuator and at least one counterbalancing member coupling the platform to the pivot structure, the at least one actuator and the at least one counterbalancing member generating a force opposite to the force generated by rotation of the pivot structure; and, a drive for rotating the pivot structure about the pivot axis to move the platform from a generally horizontal first position to a generally vertical second position.

2. An amusement ride assembly of claim 1, further comprising a screen, the screen positioned opposed to and across from a front edge of the platform.

3. The amusement ride assembly of claim 2, wherein the screen has a shape selected from the group consisting of flat, spherical, semi spherical, hemispherical, arcuate, and semi-conical.

4. The amusement ride assembly of claim 1, further comprising a pivot axis stopping member adapted to arrest movement of the pivot structure when the pivot structure approaches at least one of the first position and the second position.

5. The amusement ride assembly of claim 1, further comprising at least one shock absorbers positioned between the stationary support structure and the pivot structure.

6. The amusement ride assembly of claim 1, wherein the platform further comprises at least one linear guide member extending longitudinally across the platform at a position adjacent an outside longitudinal edge of the platform, the linear guide member adapted to permit translation of the platform relative to the second pivot means along the longitudinally extending heave axis.

7. The amusement ride assembly of claim 1, wherein the counterweight is adapted to position the overall center of gravity of the pivot structure closer to the pivot axis.

8. The amusement ride assembly of claim 1, wherein the at least one actuator is a roller screw electrically driven actuator.

9. The amusement ride assembly of claim 1, further comprising a locking member adapted to lock the platform relative to the second pivot means.

10. The amusement ride assembly of claim 1, further comprising a locking member adapted to lock the pivot structure relative to the stationary support structure.

11. The amusement ride assembly of claim 1, wherein the drive member further comprises at least one pair of slew drives.

12. The amusement ride assembly of claim 1, wherein the at least one pair of slew drives further comprises at least one worm gear, a planetary gear box and a gear box motor.

13. The amusement ride assembly of claim 1, wherein the seat drive member is operably linked to a seat pitch crank rotatably connected to a seat pitch crank support and connected to the upper surface of the platform, the seat pitch crank operably linked to the at least one seat actuating member.

14. The amusement ride assembly of claim 1, further comprising a seat drive linkage having a first end and a second end, the first end pivotably connected to each of the at least two seats, the second end pivotably connected to the upper surface of the platform.

15. The amusement ride assembly of claim 1, wherein the at least one seat frame bracket further comprises a seat bearing support.

16. The amusement ride assembly of claim 1, further comprising a ride control system.

* * * * *